US011045861B2

(12) United States Patent
Kawai et al.

(10) Patent No.: US 11,045,861 B2
(45) Date of Patent: Jun. 29, 2021

(54) FASTENING TOOL

(71) Applicant: MAKITA CORPORATION, Anjo (JP)

(72) Inventors: Yuki Kawai, Anjo (JP); Michisada Yabuguchi, Anjo (JP); Hiroki Ikuta, Anjo (JP); Toshihito Yabunaka, Anjo (JP)

(73) Assignee: MAKITA CORPORATION, Anjo (JP)

( * ) Notice: Subject to any disclaimer, the term of this patent is extended or adjusted under 35 U.S.C. 154(b) by 161 days.

(21) Appl. No.: 16/465,120

(22) PCT Filed: Nov. 24, 2017

(86) PCT No.: PCT/JP2017/042304
§ 371 (c)(1),
(2) Date: May 29, 2019

(87) PCT Pub. No.: WO2018/101179
PCT Pub. Date: Jun. 7, 2018

(65) Prior Publication Data

US 2019/0283110 A1 Sep. 19, 2019

(30) Foreign Application Priority Data

Nov. 30, 2016 (JP) ..... JP2016-233636

(51) Int. Cl.
*B21J 15/26* (2006.01)
*B21J 15/28* (2006.01)
*B21J 15/02* (2006.01)

(52) U.S. Cl.
CPC ..... *B21J 15/26* (2013.01)

(58) Field of Classification Search
CPC ..... B21J 15/26; B21J 15/28; B21J 15/022
See application file for complete search history.

(56) References Cited

U.S. PATENT DOCUMENTS 4,562,389 A 12/1985 Jundt et al.
5,655,289 A * 8/1997 Wille ..... B21J 15/26 29/243.53

(Continued)

FOREIGN PATENT DOCUMENTS

CN 201124214 Y 10/2008
EP 0 653 259 A1 5/1995

(Continued)

OTHER PUBLICATIONS

Jun. 4, 2019 International Preliminary Report on Patentability issued in International Patent Application No. PCT/JP2017/042304.

(Continued)

*Primary Examiner* — Bayan Salone
(74) *Attorney, Agent, or Firm* — Oliff PLC

(57) ABSTRACT

A fastening tool includes a bolt-gripping part, an anvil, a motor, and a control part. When the bolt-gripping part grips an end region of a shaft part and moves relative to the anvil in a first direction of a longitudinal-axis direction, the anvil presses a collar fitted onto the shaft part in a second direction opposite to the first direction of the longitudinal-axis direction and inward in a radial direction of the collar, so that a hollow part of the collar is crimped to a groove while the workpiece is clamped between the collar and a head part, whereby swaging of a fastener is completed while the end region remains integrated with the shaft part. The control part completes swaging of the fastener by terminating a movement of the bolt-gripping part in the first direction relative to the anvil based on driving current of the motor.

9 Claims, 18 Drawing Sheets

(56) References Cited

U.S. PATENT DOCUMENTS

| | | | | |
|---|---|---|---|---|
| 5,666,710 | A | 9/1997 | Weber et al. | |
| 6,145,360 | A | 11/2000 | Honsel et al. | |
| 10,112,232 | B2 * | 10/2018 | Honsel | B21J 15/26 |
| 2003/0115743 | A1 * | 6/2003 | Fulbright | B21J 15/28 29/715 |
| 2015/0074964 | A1 * | 3/2015 | Masugata | B21J 15/26 29/243.526 |
| 2015/0135907 | A1 * | 5/2015 | Hirabayashi | B25B 23/1475 81/54 |
| 2016/0114383 | A1 * | 4/2016 | Honsel | B21J 15/26 29/525.07 |

FOREIGN PATENT DOCUMENTS

| | | | | |
|---|---|---|---|---|
| EP | 653259 | A1 * | 5/1995 | B21J 15/26 |
| EP | 0 953 388 | A2 | 11/1999 | |
| EP | 0953388 | A2 * | 11/1999 | B21J 15/043 |
| EP | 2 985 094 | A1 | 2/2016 | |
| EP | 2985094 | A1 * | 2/2016 | B21J 15/26 |
| JP | H07-164092 | A | 6/1995 | |
| JP | H09-144728 | A | 6/1997 | |
| JP | 2000-190139 | A | 7/2000 | |
| JP | 2004-508932 | A | 3/2004 | |
| JP | 2013-248643 | A | 12/2013 | |
| WO | 02/23056 | A1 | 3/2002 | |
| WO | 2011/102559 | A1 | 8/2011 | |
| WO | WO-2011102559 | A1 * | 8/2011 | B25B 21/02 |
| WO | 2014/195189 | A1 | 12/2014 | |
| WO | WO-2014195189 | A1 * | 12/2014 | B25B 27/0014 |

OTHER PUBLICATIONS

Jan. 16, 2018 International Search Report issued in International Patent Application No. PCT/JP2017/042304.

Jun. 5, 2020 Extended Search Report issued in European Patent Application No. 17875120.2.

Aug. 4, 2020 Office Action issued in Japanese Patent Application No. 2016-233636.

Mar. 13, 2020 Office Action issued in Chinese Patent Application No. 201780072690.3.

* cited by examiner

FASTENING TOOL

TECHNICAL FIELD

The present invention relates to a fastening tool which uses a fastener including a bolt and a cylindrical hollow collar that is engageable with the bolt, the bolt having a head part integrally formed with a shaft part having a groove, to fasten a workpiece between the head part and the collar.

BACKGROUND ART

As for a fastening operation of a workpiece using the fastener configured as described above, two types are known. Firstly, swaging operation may be completed while an end region of the shaft part of the bolt remains integrated with the shaft part. Secondly, swaging operation may be completed while the end region of the shaft part is broken and removed from the shaft part. The former type (first type) may be advantageous in that an additional process of reapplying a coating agent to a broken part can be omitted since the fastening operation is performed without breaking the shaft part. The latter type (second type) may be advantageous in that the fastener is reduced in height when the swaging operation is completed since the end region of the shaft part is broken and removed.

As an example of a fastening tool using a fastener of the above-described first type, WO 2002/023056 discloses a fastening tool, including a bolt-gripping part configured to grip an end region of a shaft part, and an anvil configured to be engaged with a collar. The bolt-gripping part is moved relative to the anvil by utilizing fluid pressure generated by a piston-cylinder, so that the anvil presses the collar and the workpiece is clamped between the collar and the head part.

In the fastening tool for fastening a workpiece using a fastener of the above-described first type, close output management is required in a swaging operation, in order to perform the swaging operation without breaking the end region of the shaft part. In the above-described fastening tool, output is controlled utilizing the fluid pressure, which facilitates the output control required for swaging, but it is difficult to realize a simple and compact device structure.

Further, apart from the above-described fasteners, an electric fastening tool using a so-called blind rivet is also known as disclosed, for example, in Japanese Unexamined Patent Application Publication No. 2013-248643. In this case, the fastening operation using the blind rivet is completed with the shaft part broken, so that there is little need for close output management which is required in swaging the fastener of the above-described first type.

SUMMARY OF THE INVENTION

Problem to be Solved by the Invention

Accordingly, it is an object of the present invention to provide a fastening tool using a fastener of the above-described first type, which is configured such that swaging operation is completed while an end region of a shaft part of a bolt remains integrated with the shaft part, and more particularly to provide a technique that may help provide a compact device structure while facilitating output management required for swaging, in the fastening tool.

Embodiment to Solve the Problem

A fastening tool according to the present invention is provided in order to solve the above-described problem. The fastening tool uses a fastener including a bolt and a cylindrical hollow collar that is engageable with the bolt, the bolt having a head part integrally formed with a shaft part having a groove, to fasten a workpiece between the head part and the collar.

The fastening tool according to the present invention includes a bolt-gripping part, an anvil, a motor and a control part. The bolt-gripping part is configured to grip an end region of the shaft part. The anvil is configured to be engaged with the collar. The motor is configured to drive and move the bolt-gripping part relative to the anvil in a specified longitudinal-axis direction. The control part is configured to control driving of the motor.

The fastening tool is configured such that, when the bolt-gripping part grips the end region of the shaft part and moves relative to the anvil in a specified first direction of the longitudinal-axis direction, the anvil presses the collar fitted onto the shaft part in a second direction opposite to the first direction of the longitudinal-axis direction and inward in a radial direction of the collar, so that a hollow part of the collar is crimped to the groove while the workpiece is clamped between the collar and the head part, whereby swaging of the fastener is completed while the end region remains integrated with the shaft part.

In the present invention, the bolt-gripping part for gripping the end region of the shaft part of the bolt is configured to move in the specified longitudinal-axis direction via the motor relative to the anvil engaged with the collar. With this structure, the fastening tool with a simple and compact structure can be realized, compared with a fastening tool utilizing fluid pressure.

Further, in the present invention, the controller is configured to complete swaging of the fastener by terminating a movement of the bolt-gripping part in the first direction relative to the anvil based on driving current of the motor. In order to complete the swaging of the fastener while the end region of the bolt shaft part remains integrated with the shaft part, it is necessary to appropriately manage output in the swaging operation so as to protect the bolt-gripping part or the end region of the shaft part from an overload. In the present invention, focusing on the motor which drives the bolt-gripping part, the output management in the swaging operation is performed based on the driving current of the motor. Specifically, when a swaging force increases as the swaging operation progresses, the output of the motor, which is a driving source for the swaging operation, increases. Therefore, focusing on this point, the output management in the swaging operation is performed based on the driving current of the motor. Typically, when a driving current value of the motor reaches a specified threshold or when an index value corresponding to or associated with the driving current value reaches a specified threshold set for the index value, the control part may terminate the movement of the bolt-gripping part relative to the anvil in the first direction and thereby completes the swaging of the fastener. If the driving current increases beyond the threshold, there arises a possibility that the fastener is subjected to an overload caused by excessive torque of the motor and the bolt-gripping part or the end region of the shaft part is broken. According to present invention, however, the risk of such breakage can be reliably reduced.

As the "motor" in the present invention, a compact brushless motor having high output may be suitably employed, but it is not limited to this. Further, a direct current (DC) battery which can be mounted to the fastening tool may be suitable as a means for supplying driving current to the motor, but, for example, an alternate current (AC) power source may also be employed.

As the "driving current" in the present invention, for example, a current value in a motor driving circuit of the fastening tool, or an output current value in a battery if the battery is used as a driving source, may be appropriately used. Further, the manner of completing swaging of the fastener "based on the driving current" may typically refer to the manner of completing the swaging of the fastener by detecting the driving current value itself, but may also include the manner of completing the swaging of the fastener based on another physical quantity which corresponds to the driving current value, such as an internal resistance value or a voltage drop value of a DC battery if the DC battery is used.

The "workpiece" in the present invention may typically consist of a plurality of members to be fastened each having a through hole, and the members to be fastened may be suitably formed of metal material requiring fastening strength. In this case, it may be preferable that the members to be fastened each having a through hole are superimposed such that the through holes are aligned with each other, or the members to be fastened are superimposed and then the through holes are formed therethrough. In this state, it may be preferable that the shaft part of the bolt of the fastener is inserted through the through holes, and the fastener is set such that the head part of the bolt is arranged on one end side of the aligned through holes and the collar is arranged on the other end side.

The "fastening tool" according to the present invention may be suitably used in cases where a workpiece needs to be fastened with especially high strength, such as in manufacturing transport equipment such as aircrafts and automobiles, and in fastening an installation base for a solar panel or a plant.

The "bolt-gripping part" in the present invention may comprise a plurality of claws (also referred to as jaws) which can be engaged with the end region of the shaft part.

The "bolt" in the present invention may also be defined as a pin. In the present invention, the "groove" to which the hollow part of the collar is crimped (swaged) may be formed at least in a crimping position of the shaft part, but grooves may be formed elsewhere in the shaft part or over the whole length of the shaft part. The groove(s) formed in a position other than the crimping position may be used, for example, to position or temporarily fix the collar.

The "anvil" in the present invention may preferably be a metal anvil configured to deform the collar by a swaging force and may preferably have a bore (open hollow part) for receiving the outer periphery of the collar.

Specifically, the "anvil" may preferably be configured such that the bore has a tapered part and has a diameter smaller than the outer diameter of a swaging region of the collar. With this structure, when the bolt-gripping part moves in a fastening direction relative to the anvil, the tapered part presses the collar in the longitudinal-axis direction in abutment with the collar, and along with a further relative movement of the bolt-gripping part, the collar proceeds into the bore of the anvil while being pressed inward in the radial direction by the tapered part. As a result, the collar clamps the workpiece in cooperation with the head part, and is pressed inward in the radial direction by the bore of the anvil and deformed to be reduced in diameter, so that the hollow part of the collar is crimped (swaged) into the groove of the shaft part. Thus, the collar is swaged onto the bolt and the workpiece is fastened by the fastener.

In a preferred aspect of the invention, the control part may complete the swaging of the fastener further based on an amount of change in rotation speed of the motor.

In the present invention, the output management in the swaging operation is performed based on the driving current of the motor. As a general character of a motor, a large starting current (an inrush current or a rush current at startup) may be outputted at start of the motor. In the present invention in which the output management in the above-described swaging operation is performed based on the driving current of the motor, if a large starting current is outputted in an initial motor driving stage, the large starting current may be erroneously determined as a high output generated upon completion of swaging operation and the swaging operation may be terminated in an uncompleted state. Therefore, in the present aspect, the control may be performed based on not only the driving current of the motor, but also on the amount of change in the rotation speed of the motor. When a large starting current is outputted in the initial motor driving stage, the rotation speed of the motor increases at startup, so that the amount of change in the rotation speed of the motor takes on a positive value. On the other hand, when the swaging operation progresses and nears completion, the rotation speed of the motor decreases with increase of the output (a high-torque and low-rotation-speed state of the motor), so that the amount of change in the rotation speed of the motor takes on a negative value. Therefore, the additional control based on the amount of change in the rotation speed of the motor may realize further reliable determination as to whether the large driving current is outputted as a large starting current in the initial motor driving stage, or outputted as a result of a progress in the swaging operation. Further, as the "amount of change" in the rotation speed of the motor, a differential value or a difference of a rotation speed of the motor per unit time, or an amount of change (a differential value or a difference) in another physical quantity corresponding to the rotation speed of the motor may be appropriately employed.

In a further preferred aspect of the invention, the control part may complete the swaging of the fastener through comparison between the driving current of the motor and a specified threshold, and the threshold may be adjustable. Generally, a force required for swaging may differ according to the material of the workpiece and the specifications of the fastener. Therefore, it may be preferable that the threshold of the motor driving current for completing the swaging of the fastener can be appropriately adjusted according to a working condition.

The threshold may be suitably adjusted, for example, by operating from the outside of the fastening tool so as to facilitate the adjusting operation, or may be adjusted automatically by the control part through detection of one or more working conditions such as the material of the workpiece and the specifications of the fastener.

In a further preferred aspect of the invention, the control part may control a starting current of the motor so as not to exceed the threshold. With this structure, the controller can be effectively avoided from erroneously determining that the swaging operation is completed based on the large starting current in the initial motor driving stage.

In a further preferred aspect of the invention, when the threshold is adjusted, the control part may control a starting current of the motor according to the adjusted threshold.

With this structure, the controller may be further effectively avoided from erroneously determining that the swaging operation is completed based on the large starting current in the initial motor driving stage.

In a further preferred aspect of the invention, relating to the control of the above-described starting current, the control part may be configured to control a target rotation speed of the motor. The target rotation speed of the motor may be defined as a steady driving speed of the motor. In a case where pulse width modulation (PWM) drive control is performed, the target rotation speed of the motor may be defined by setting a target duty ratio.

With the structure in which the controller controls the target rotation speed of the motor in controlling the starting current, the controller may be further effectively avoided from erroneously determining that the swaging operation is completed based on the large starting current in the initial motor driving stage.

In a further preferred aspect of the invention, the control part may be configured to control the motor to soft-start according to a set threshold. The starting characteristic that the rotation speed of the motor gradually increases can be obtained by the soft-start control, which may help suppress generation of the large starting current in the initial motor driving stage.

Particularly, when the motor is controlled to be soft-started, it may be preferred to change the soft-starting manner, that is, the manner of increasing the rotation speed of the motor up to the target rotation speed, according to the threshold. For example, in a case where a relatively large threshold is set and a rather large starting current may be generated, considering that the possibility of the large starting current exceeding the relatively large threshold is low, the rate of increase in the rotation speed of the motor during soft-start may be increased. As a result, the rotation speed of the motor can be promptly increased, while the control part can be avoided from erroneously determining that the swaging operation is completed based on the large starting current, so that the working efficiency can be improved. On the other hand, in a case where a relatively small threshold is set, considering that it is quite possible that the large starting current exceeds the relatively small threshold, the rate of increase in the rotation speed of the motor during soft-start may be reduced. As a result, the possibility of erroneously determining that the swaging operation is completed based on the large starting current can be minimized.

In a further preferred aspect of the invention, the control part may be configured to limit the driving current of the motor to a specified set current value or below for a specified period of time after start of the motor.

For the specified period of time after the start of the motor, which is defined as an initial motor driving stage, the driving current of the motor may be limited to the specified current value or below, which can help suppress generation of the large starting current in the initial motor driving stage. Further, the control part may be configured such that the set current value is variable according to the threshold.

In a preferred aspect of the invention, the control part may be configured to suspend determination of completion of the swaging operation until a specified period of time elapses from the start of the motor. Specifically, the control part may be configured to terminate the movement of the bolt-gripping part relative to the anvil in the first direction based on the driving current of the motor only when a specified period of time elapses from the start of the motor.

It is generally known that a large starting current of a motor is likely to be generated by motor inductance or initial charge of a capacitor in a state leading to a steady state. However, with the control part configured not to determine completion of the swaging operation until the specified period of time elapses from the start of the motor or in the initial motor driving stage, the possibility of erroneously determining that the swaging operation is completed based on the large starting current in the initial motor driving stage can be eliminated.

Effect of the Invention

According to the present invention, a fastening tool is provided using a fastener of a type in which a swaging operation is completed while an end region of a shaft part of a bolt remains integrated with the shaft part, and more particularly, a technique is provided which may help provide a compact device structure while facilitating output management required for swaging, in the fastening tool.

DESCRIPTION OF EMBODIMENT

First Embodiment

A fastening tool 100 that is configured to fasten a workpiece via a fastener is now explained as an embodiment (first embodiment) of the present invention with reference to the drawings.

Figure 1:
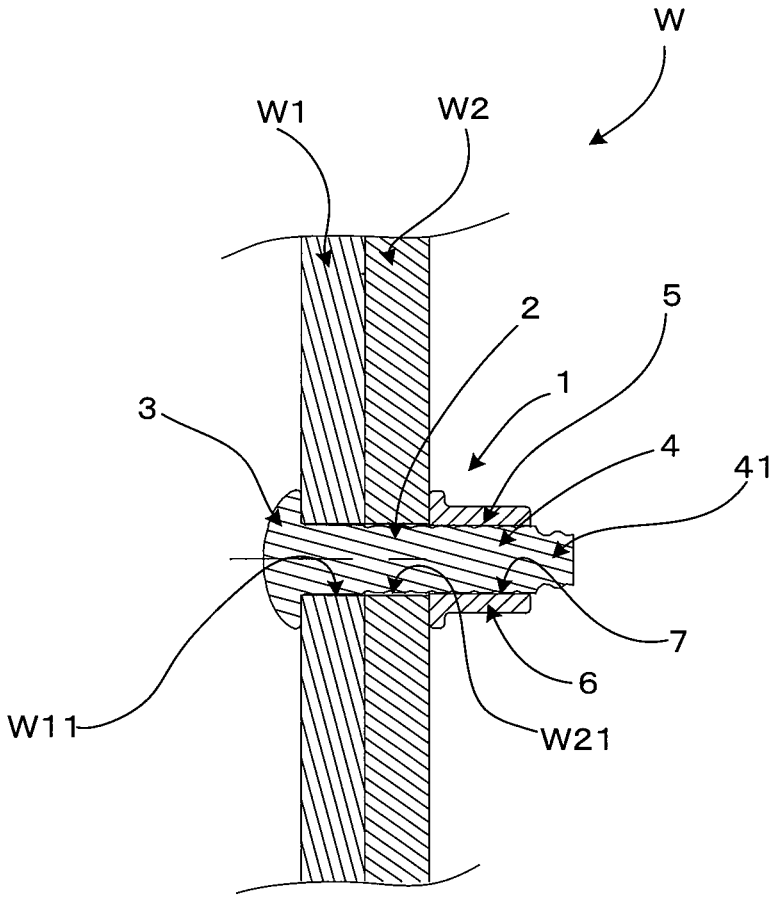
FIG. 1 is a sectional front view showing a workpiece and a fastener according to an embodiment of the invention.

FIG. 1 shows a workpiece W and a fastener 1 according to an embodiment of the present invention. In the present embodiment, as an example, the workpiece W consists of plate-like metal members W1, W2 to be fastened, and the members W1, W2 to be fastened are superimposed such that through holes W11, W21 respectively formed in advance in the members W1, W2 to be fastened are aligned with each other.

The fastener 1 mainly includes a bolt 2 and a collar 6. The bolt 2 has a head 3 and a bolt shaft 4 integrally formed with the head 3 and having grooves 5 formed in its outer periphery. The head 3 is an example that corresponds to the "head part" according to the present invention. The grooves 5 are formed over substantially the whole length in the axial direction of the bolt shaft 4. The collar 6 has a cylindrical shape having a hollow collar part 7 and may be engaged with the bolt 2 such that the bolt shaft 4 is inserted through the hollow collar part 7. An inner wall of the hollow collar part 7 has a smooth surface and, although not particularly shown, has an engagement part for temporarily fixing the collar 6 fitted onto the bolt shaft 4. In FIG. 1, the fastener 1 is shown with the collar 6 temporarily fixed in engagement with the grooves 5 of the bolt shaft 4.

Figure 2:
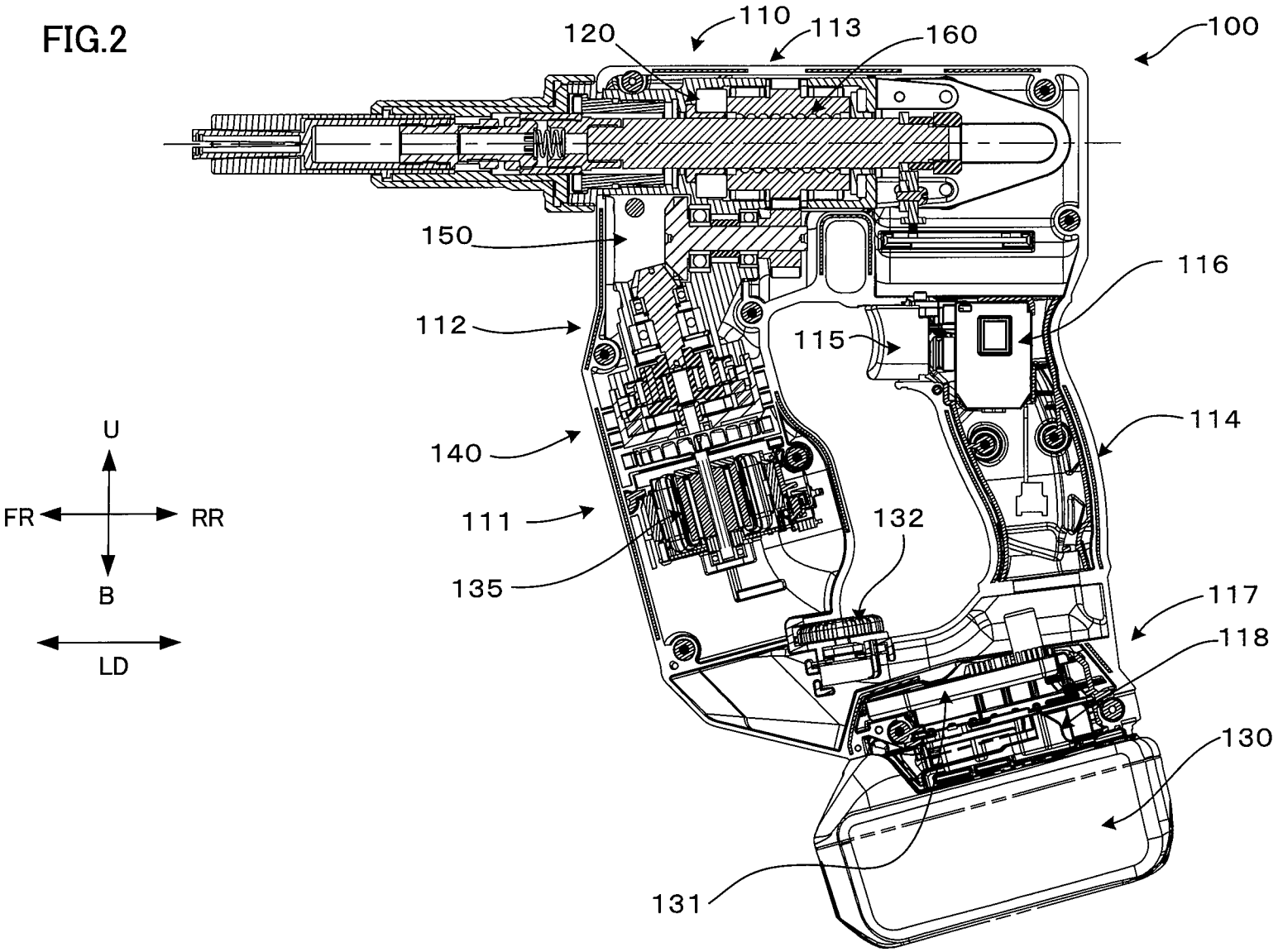
FIG. 2 is a sectional front view showing the whole structure of a fastening tool according to the embodiment of the invention.

FIG. 2 shows the whole structure of the fastening tool 100 according to the present embodiment of the present invention. The fastening tool 100 may also be referred to as a riveter or lock bolt tool.

In the following description, the symbol "FR" is defined as a front side direction (left side direction on the paper face of FIG. 2) of the fastening tool 100, the symbol "RR" a rear side direction (right side direction on the paper face of FIG. 2), the symbol "U" an upper side direction (upper side direction on the paper face of FIG. 2), the symbol "B" an lower side direction (lower side direction on the paper face of FIG. 2), the symbol "L" a left side direction (lower side direction on the paper face of FIG. 5), the symbol "R" a right side direction (upper side direction on the paper face of FIG. 5), and the symbol "LD" an extending direction of a longitudinal axis of the fastening tool, that is, a longitudinal-axis direction (left-right direction on the paper face of FIG. 2). These symbols are appropriately shown in the drawings.

The rear side direction RR, the front side direction FR and the longitudinal-axis direction LD in the present embodiment are examples that correspond to the "first direction", the "second direction" and the "longitudinal-axis direction", respectively, according to the present invention.

As shown in FIG. 2, an outer shell of the fastening tool 100 mainly includes an outer housing 110 and a grip part 114 connected to the outer housing 110.

The outer housing 110 mainly includes a motor housing region 111 for housing a motor 135, an inner-housing housing region 113 for housing an inner housing 120, and a controller housing region 117 for housing a controller 131. The inner housing 120 is a housing member for a planetary-gear speed-reducing mechanism 140, a bevel-gear speed-reducing mechanism 150 and a ball-screw mechanism 160, which will be described in detail later. A battery mounting part 118 is provided on a lower end portion of the controller housing region 117 and configured such that a battery 130, which serves as a driving power source for the motor 135, can be removably connected to the fastening tool 100.

In FIG. 2, a region adjacent to the motor housing region 111 in the inner-housing housing region 113 is shown as a speed-reducing-gear housing region 112 for housing the planetary-gear speed-reducing mechanism 140 and the bevel-gear speed-reducing mechanism 150.

Further, an operation dial 132 for setting a threshold relating to a driving current value of the motor 135 is provided in a connecting region between the motor housing region 111 and the controller housing region 117. An indication of thresholds (in a stepless level in the present embodiment) is printed on a display part of an upper surface of the operation dial 132, so that a user can set the threshold to any value by manually operating the operation dial 132. Details about the threshold will be described later.

A trigger 115 which is configured to be manually operated by a user and an electric switch assembly 116 which is configured to be turned on and off in response to the manual operation of the trigger 115 are arranged in the grip part 114.

The controller housing region 117, the motor housing region 111, the inner-housing housing region 113 (including the speed-reducing-gear housing region 112) and the grip part 114 are contiguously arranged to form a closed loop.

Figure 3:
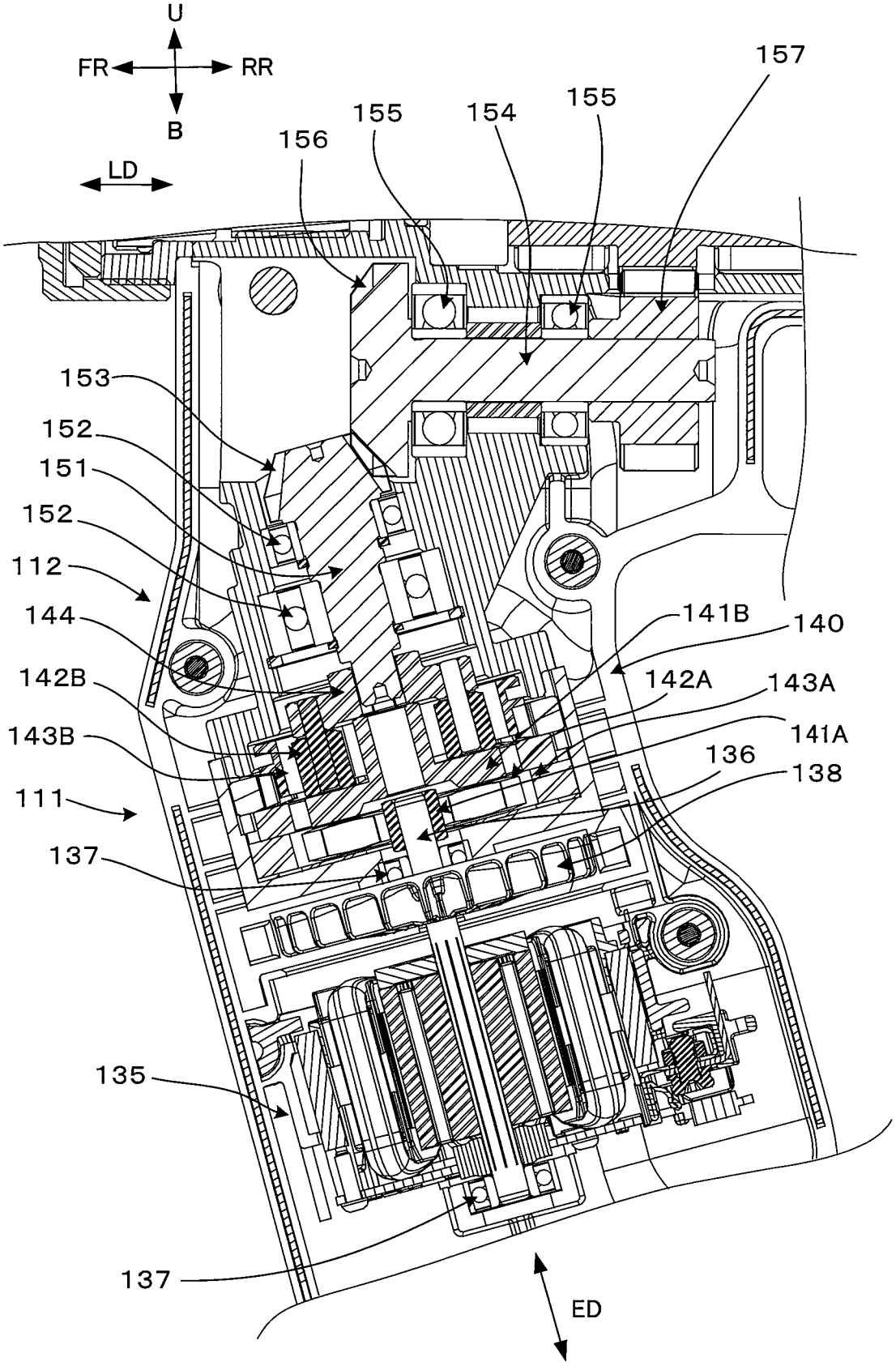
FIG. 3 is a partial sectional view showing the structure of a portion of an outer housing of the fastening tool.

FIG. 3 shows the structures of the motor housing region 111 and the speed-reducing-gear housing region 112 in detail.

A DC brushless motor is employed as the motor 135, which is housed in the motor housing region 111. A motor output shaft 136, to which a cooling fan 138 is mounted, is rotatably supported by bearings 137 at both end regions. One end of the motor output shaft 136 is connected to a first sun gear 141A of the planetary-gear speed-reducing mechanism 140 so that the motor output shaft 136 and the first sun gear 141A integrally rotate.

The planetary-gear speed-reducing mechanism 140, which is housed in the speed-reducing-gear housing region 112, is of a two-stage speed reduction type. The first speed reduction stage mainly includes the first sun gear 141A, a plurality of first planetary gears 142A meshed with the first sun gear 141A, and a first internal gear 143A meshed with the first planetary gears 142A. The second speed reduction stage mainly includes a second sun gear 141B which also serves as a carrier of the first planetary gears 142A, a plurality of second planetary gears 142B meshed with the second sun gear 141B, a second internal gear 143B meshed with the second planetary gears 142B, and a carrier 144 which is configured to rotate along with a revolving movement of the second planetary gears 142B.

The carrier 144 is connected to a drive-side intermediate shaft 151 of the bevel-gear speed-reducing mechanism 150, which is housed adjacent to the planetary-gear speed-reducing mechanism 140 within the speed-reducing-gear housing region 112, so that the carrier 144 and the drive-side intermediate shaft 151 integrally rotate.

The bevel-gear speed-reducing mechanism 150 mainly includes the drive-side intermediate shaft 151 supported at both ends by bearings 152, a drive-side bevel gear 153 provided on the drive-side intermediate shaft 151, a driven-side intermediate shaft 154 supported at both ends by bearings 155, a driven-side bevel gear 156 provided on the driven-side intermediate shaft 154, and a ball-nut drive gear 157. The "intermediate shaft" here refers to an intermediate shaft provided on a path for transmitting rotation output of the motor 135 from the motor output shaft 136 to a ball-screw mechanism 160, which will be described later (see FIG. 4). An extending direction ED of the motor output shaft 136 and the drive-side intermediate shaft 151 obliquely crosses an extending direction of the driven-side intermediate shaft 154, which is the longitudinal-axis direction LD.

Figure 4:
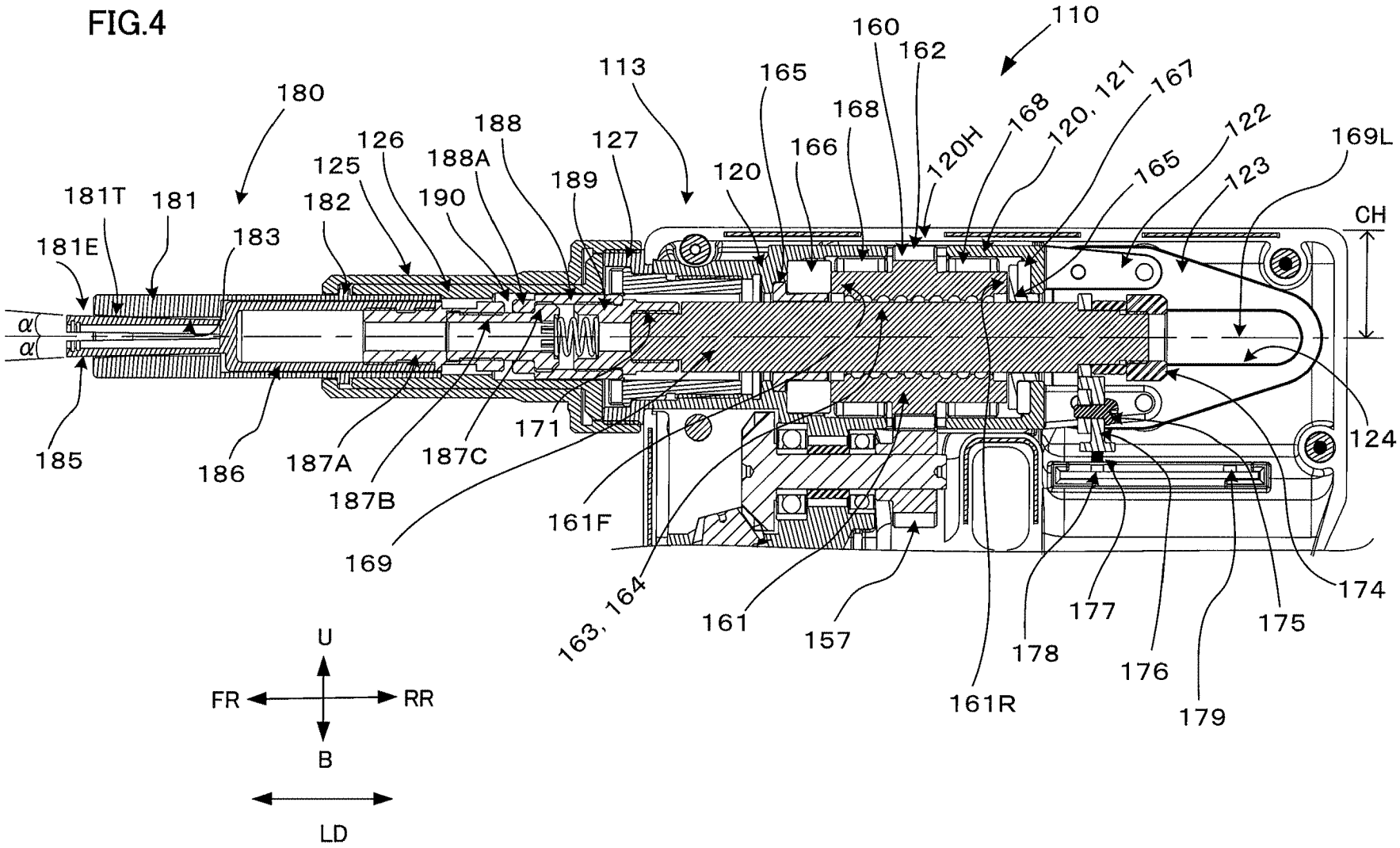
FIG. 4 is a partial sectional view showing the detailed structure of an inner housing of the fastening tool.
Figure 5:
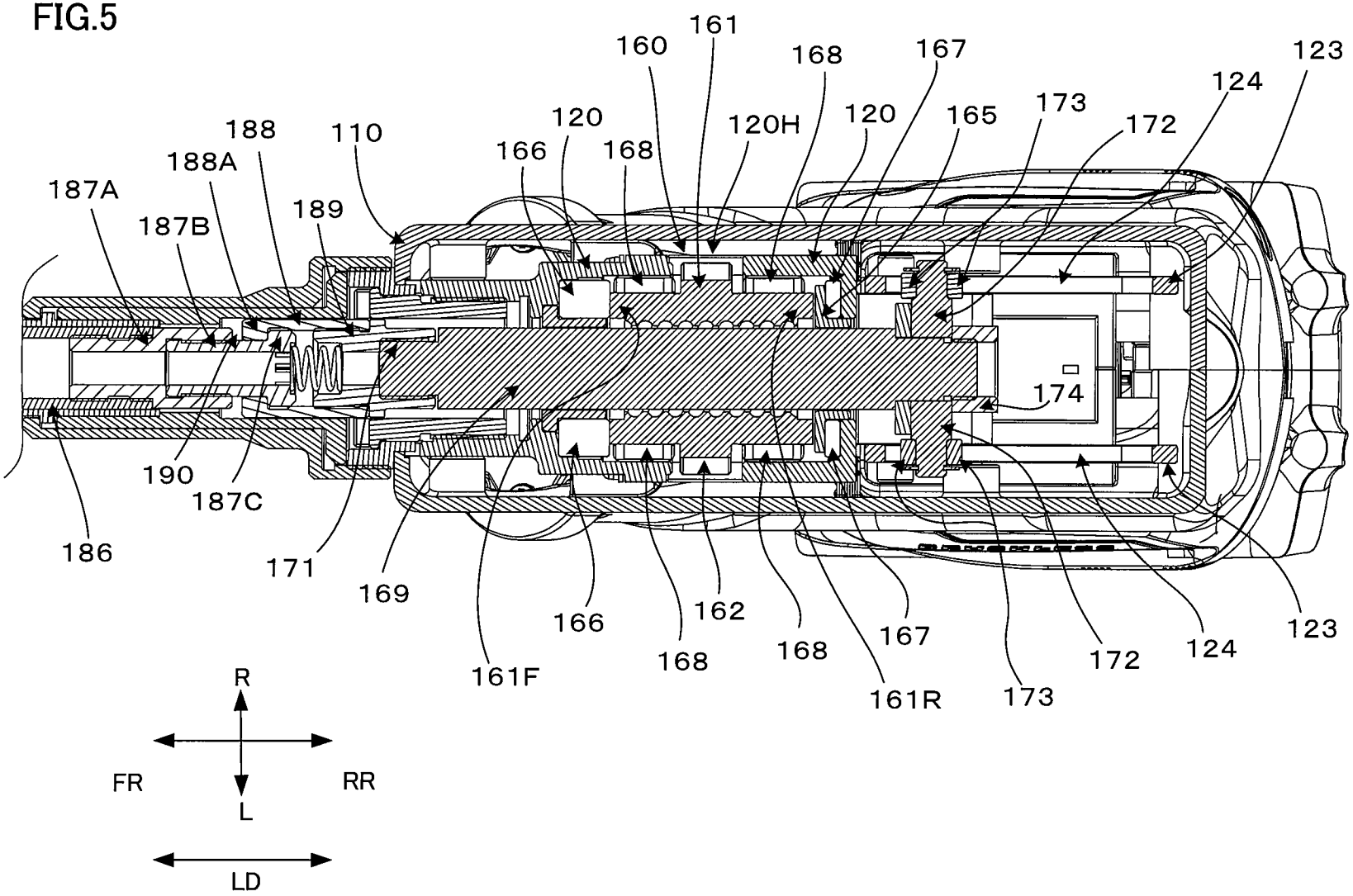
FIG. 5 is a sectional plan view corresponding to the partial sectional view of FIG. 4.

FIGS. 4 and 5 show the structure of the inner-housing housing region 113 in detail. As described above, the inner housing 120, which is housed in the inner-housing housing region 113, is a housing member for the planetary-gear speed-reducing mechanism 140, the bevel-gear speed-reducing mechanism 150 and the ball-screw mechanism 160. In the present embodiment, although not shown for convenience sake, a region of the inner housing 120 for housing the planetary-gear speed-reducing mechanism 140 is formed of resin, while a region for housing the bevel-gear speed-reducing mechanism 150 and the ball-screw mechanism 160 is formed of metal, and the both regions are integrally connected to each other with screws.

As shown in FIG. 4, guide flanges 123 are connected to an end of the inner housing 120 in the rear side direction RR via guide-flange mounting arms 122. The guide flanges 123 each have an elongate guide hole 124 extending in the longitudinal-axis direction LD.

Further, a sleeve 125 for locking an anvil 181 is connected to the other end of the inner housing 120 in the front side direction FR via a joint sleeve 127. The sleeve 125 is formed as a cylindrical body having a sleeve bore 126 extending in the longitudinal-axis direction LD.

The inner housing 120 has a ball-screw housing region 121 which houses the ball-screw mechanism 160. The ball-screw mechanism 160 is an example that corresponds to a "bolt-gripping part driving mechanism" according to the present invention.

The ball-screw mechanism 160 mainly includes a ball nut 161 and a ball-screw shaft 169. A driven gear 162 is formed on an outer periphery of the ball nut 161 and engaged with the ball-nut drive gear 157. The driven gear 162 receives the rotation output of the motor from the ball-nut drive gear 157, which causes the ball nut 161 to rotate around the longitudinal axis LD. Further, the ball nut 161 has a bore 163 extending in the longitudinal-axis direction LD. A groove part 164 is provided in the bore 163.

The ball nut 161 is supported at both ends by the inner housing 120 via a plurality of radial needle bearings 168 spaced apart from each other in the longitudinal-axis direction LD, so that the ball nut 161 is rotatable around the longitudinal axis LD. Further, a thrust ball bearing 166 is disposed between the ball nut 161 and the inner housing 120 on a front end part 161F of the ball nut 161 in the front side direction FR. With this structure, even if an axial force (thrust load) in the longitudinal-axis direction LD is applied to the ball nut 161, the thrust ball bearing 166 allows the ball nut 161 to smoothly rotate around the longitudinal-axis direction LD, while reliably receiving the axial force, thereby avoiding the risk that a strong axial force may impede rotation of the ball nut 161 around the longitudinal-axis direction LD.

Further, a thrust needle bearing 167 is disposed between the ball nut 161 and the inner housing 120 on a rear end part 161R of the ball nut 161 in the rear side direction RR. With this structure, even if an axial force (thrust load) in the longitudinal-axis direction LD is applied to the ball nut 161, the thrust needle bearing 167 allows the ball nut 161 to rotate around the longitudinal-axis direction LD, while reliably receiving the axial force in the longitudinal-axis direction LD, thereby avoiding the risk that a strong axial force may adversely affect rotation of the ball nut 161 around the longitudinal-axis direction LD. In the present embodiment, a thrust washer 165 is further disposed between the ball nut 161 and the thrust ball bearing 166, and also between the ball nut 161 and the thrust needle bearing 167.

As shown in FIG. 4, the thrust ball bearing 166 and the thrust needle bearing 167 are each configured to have a diameter larger than an outer diameter of the ball nut 161 at the front and rear end parts 161F, 161R of the ball nut 161. In this manner, the axial force (thrust load) applied to the ball nut 161 per unit area can be avoided from being increased due to reduction of the diameter, so that the operating performance and durability can be improved.

Further, as shown in FIGS. 4 and 5, the ball-screw shaft 169 is configured as an elongate body which extends in the longitudinal-axis direction LD. The ball-screw shaft 169 has a groove part (not shown for the convenience sake) formed in its outer periphery. The groove part is engaged with the groove part 164 of the ball nut 161 via balls. The ball-screw shaft 169 is configured to be linearly moved in the longitudinal-axis direction LD by rotation of the ball nut 161 around the longitudinal-axis direction LD. Specifically, the ball-screw shaft 169 serves as a motion converting mechanism for converting rotation of the ball nut 161 around the longitudinal-axis direction LD into linear motion in the longitudinal-axis direction LD.

The outer periphery of the driven gear 162 is dimensioned to be generally flush with an outer surface of the inner housing 120 through a notch-like hole 120H formed in the inner housing 120. In other words, the driven gear 162 is configured such that the outer periphery of the driven gear 162 does not protrude in the upper side direction U from the outer surface of the inner housing 120. This structure may contribute to reduction in a height (also referred to as a center height) CH from a shaft line 169L of the ball-screw shaft 169 to an outer surface of the outer housing 110 in the upper side direction U.

The ball-screw shaft 169 is integrally connected to a second connection part 189 of a bolt-gripping mechanism 180 (described later) via a threaded engagement part 171 formed in an end region of the ball-screw shaft 169 in the front side direction FR. Further, in an end region of the ball-screw shaft 169 in the rear side direction RR, an end cap 174 is provided, and as shown in FIG. 5, a pair of left and right rollers 173 are provided via left and right roller shafts 172 which are provided adjacent to the end cap 174 and protrude in the left side direction L and the right side direction R, respectively. The rollers 173 are rollably supported by the guide holes 124 of the guide flanges 123, respectively. Therefore, the ball-screw shaft 169 is stably supported in two different regions in the longitudinal-axis direction LD (supported at the both ends) via the ball nut 161 supported by the inner housing 120 and the guide holes 124 in which the rollers 173 are fitted. The ball-screw shaft 169 may be subjected to rotation torque around the longitudinal-axis direction LD when the ball nut 161 rotates around the longitudinal-axis direction LD. By abutment between the rollers 173 and the guide holes 124, however, the ball-screw shaft 169 can be prevented from being rotated around the longitudinal-axis direction LD due to such rotation torque.

Further, as shown in FIG. 4, a magnet 177 is provided adjacent to the end cap 174 on the ball-screw shaft 169 via an arm mounting screw 175 and an arm 176. The magnet 177 is thus integrally provided on the ball-screw shaft 169, and moves together with the ball-screw shaft 169 when the ball-screw shaft 169 moves in the longitudinal-axis direction LD.

In the outer housing 110, an initial-position sensor 178 is provided in a position corresponding to a position in which the magnet 177 is located when the ball-screw shaft 169 is moved to its maximum extent in the front side direction FR as shown in FIG. 4, and a rearmost-end-position sensor 179 is provided in a position corresponding to a position in which the magnet 177 is located when the ball-screw shaft 169 is moved to its maximum extent in the rear side direction RR. Each of the initial-position sensor 178 and the rearmost-end-position sensor 179 is formed by a Hall element, and forms a position detecting mechanism configured to detect the position of the magnet 177. In the present embodiment, the initial-position sensor 178 and the rearmost-end-position sensor 179 are configured to detect the position of the magnet 177 when the magnet 177 is located within their respective detection ranges. FIG. 4 shows the fastening tool 100 placed in the "initial position".

As shown in FIG. 4, the bolt-gripping mechanism 180 mainly includes an anvil 181 and bolt-gripping claws 185. The bolt-gripping mechanism 180 or the bolt-gripping claws 185 is an example that corresponds to the "bolt-gripping part" according to the present invention.

The anvil 181 is configured as a cylindrical body having an anvil bore 183 extending in the longitudinal-axis direction LD. The anvil bore 183 has a tapered part 181T extending a specified distance in the longitudinal-axis direction LD from an opening 181E formed at its front end in the front side direction FR. The tapered part 181T has an inclination of angle $\alpha$ so as to be gradually tapered (narrower) in the rear side direction RR.

The anvil 181 is locked to the sleeve 125 and the sleeve bore 126 via a sleeve lock rib 182 formed on an outer periphery of the anvil 181 and is integrally connected to the inner housing 120.

The anvil bore 183 is configured to have a diameter slightly smaller than the outer diameter of the collar 6 shown in FIG. 1 such that the collar 6 may be inserted into the anvil bore 183 from the opening 181E while deforming, only when a fastening force (axial force) strong enough to deform the collar 6 is applied. The opening 181E of the anvil bore 183 is configured to have a diameter slightly larger than the outer diameter of the collar 6 so as to form an insertion guide part for guiding insertion of the collar 6 into the anvil bore 183.

The tapered part 181T is configured to have a length longer than the height of the collar 6 in the longitudinal-axis direction LD, so that the collar 6 lies within a region in which the tapered part 181T is formed in the longitudinal-axis direction LD even if the collar 6 is inserted into the anvil bore 183 to its maximum extent.

The bolt-gripping claw 185 may also be referred to as a jaw. Although not particularly shown, three such bolt-gripping claws 185 are arranged at equal intervals on an imaginary circumference when viewed in the longitudinal-axis direction LD. The bolt-gripping claws 185 are configured to grip a bolt-shaft end region 41 of the fastener 1 shown in FIG. 1. The bolt-shaft end region 41 is an example that corresponds to the "end region" according to the present invention. The bolt-gripping claws 185 are integrally formed with a bolt-gripping claw base 186. As shown in FIGS. 4 and 5, the bolt-gripping claw base 186 is connected to the ball-screw shaft 169 via a first connection part 187A, a second connection part 187B, a locking part 188, a third connection part 189 and a threaded engagement part 171. Further, as shown in FIGS. 4 and 5, the second connection part 187B and the locking part 188 are connected together by engagement between a locking flange 187C formed on a rear end of the second connection part 187B and a locking end part 188A formed on a front end of the locking part 188 in the longitudinal-axis direction LD. The locking flange 187C and the locking end part 188A are connected such that the second connection part 187B move together with the the third connection part 188 when the third connection part 188 moves in the rear side direction RR. Specifically, when the ball-screw shaft 169 moves in the rear side direction RR, the bolt-gripping claws 185 move together with the ball-screw shaft 169 in the rear side direction RR. On the other hand, when the third connection part 188 moves in the front side direction FR, the third connection part 188 moves relative to the second connection part 187B, corresponding to a space 190 formed in front of the locking end part 188A.

The ball-screw shaft 169 is configured to have a small-diameter part having the threaded engagement part 171 such that an outer periphery of the third connection part 189 is flush with an outer periphery of the ball-screw shaft 169.

Figure 6:
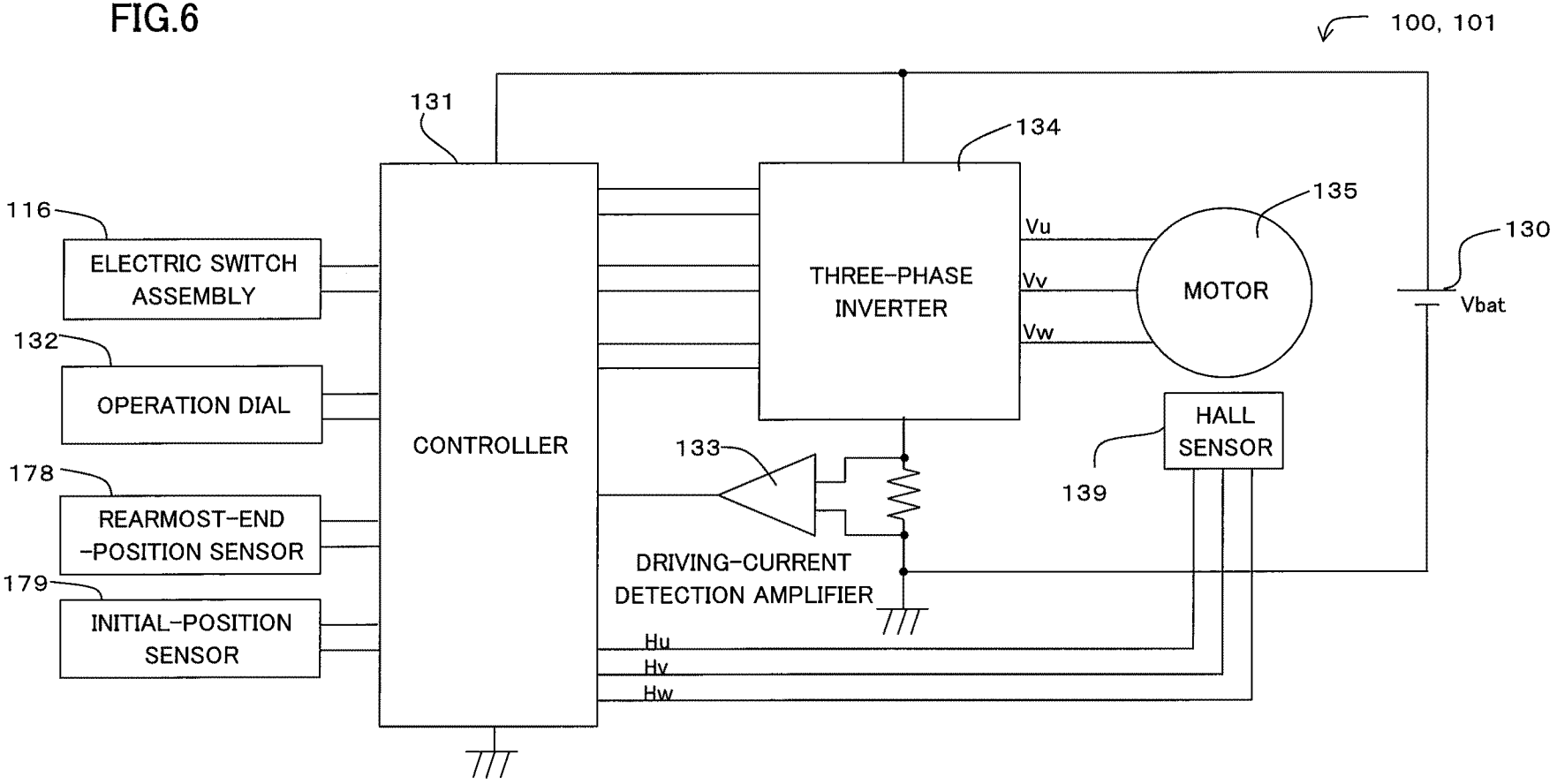
FIG. 6 is a block diagram schematically showing the structure of a motor-drive-control mechanism of the fastening tool.

FIG. 6 is a block diagram showing an electric configuration of a motor-drive-control mechanism 101 of the fastening tool 100 according to the present embodiment. The motor-drive-control mechanism 101 mainly includes a controller 131, a three-phase inverter 134, the motor 135 and the battery 130. The controller 131 is an example that corresponds to the "control part" according to the present invention. Detection signals from the electric switch assembly 116, the operation dial 132, the initial-position sensor 178, the rearmost-end-position sensor 179, and a driving-current detection amplifier 133 for the motor 135 may be inputted to the controller 131.

The driving-current detection amplifier 133 is configured to convert a driving current of the motor 135 into a voltage by shunt resistance and output a signal amplified by the amplifier to the controller 131.

In the present embodiment, the DC brushless motor which is compact and has relatively high output is employed as the motor 135, and a rotor angle of the motor 135 is detected by Hall sensors 139 and a detected value obtained by the Hall sensors 139 is transmitted to the controller 131. Further, in the present embodiment, the three-phase inverter 134 is configured to drive the brushless motor 135 by a 120-degree rectangular wave energization drive system.

Operation of the fastening tool 100 according to the present embodiment is now described.

Figure 7:
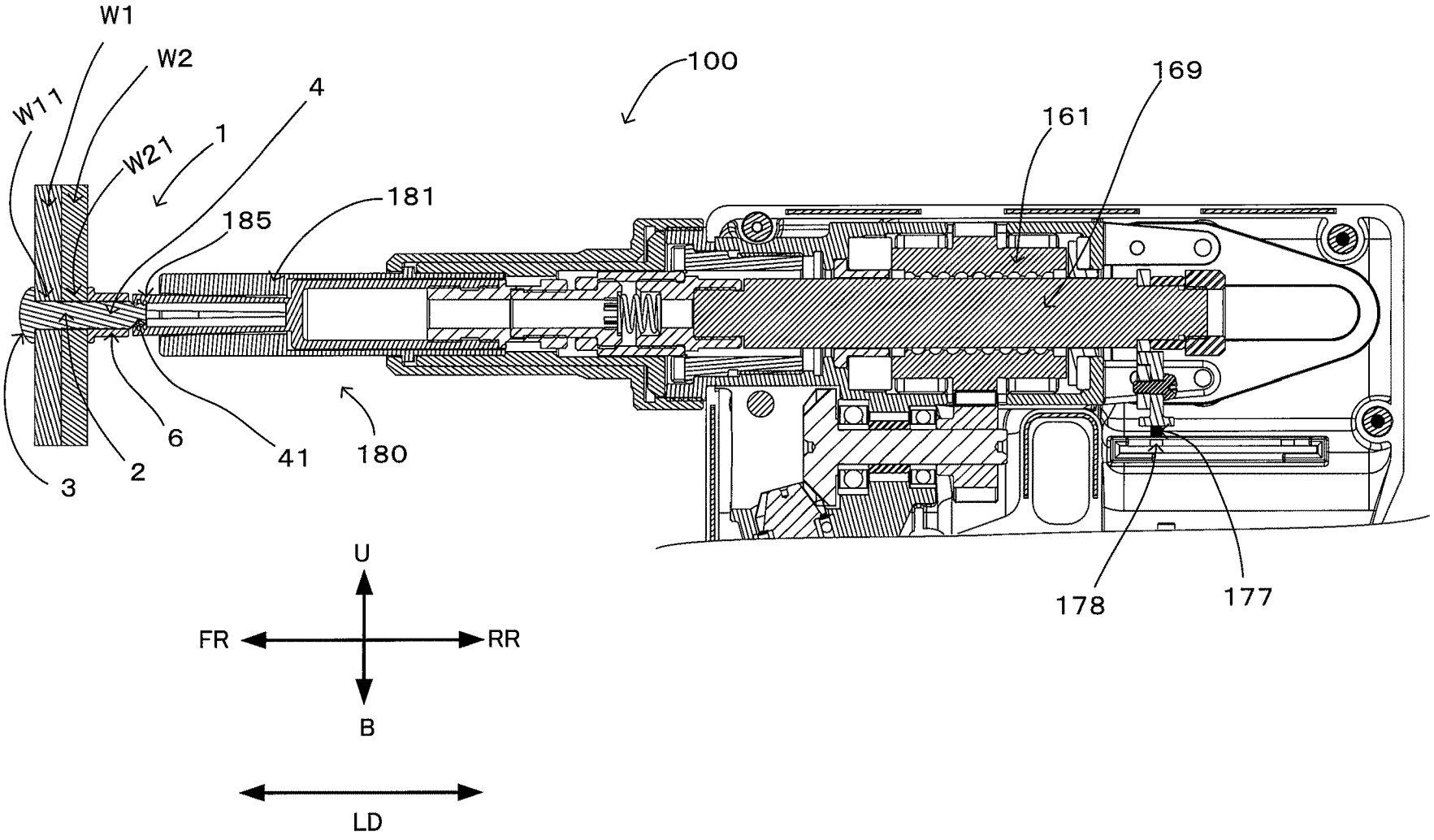
FIG. 7 is a partial sectional view showing an operation state of the fastening tool.

As shown in FIG. 7, the bolt shaft 4 of the bolt 2 is inserted through the through holes W11, W21 with the members W1, W2 to be fastened superimposed one on the other. Then the collar 6 is engaged with the bolt shaft 4 protruding to the member W2 side with the head 3 being in abutment with the member W1 to be fastened and the workpiece W is clamped (preliminarily assembled) between the head 3 and the collar 6.

After the above-described preliminary assembly, a user holds the fastening tool 100 with hand and engages the bolt-gripping claws 185 of the fastening tool 100 with the bolt-shaft end region 41. At this time, owing to the grooves 5 formed over generally the whole length of the bolt shaft 4 and a particularly large groove provided in the bolt-shaft end region 41 (see FIG. 1), the bolt-gripping claws 185 can be readily and reliably engaged with the bolt-shaft end region 41.

FIG. 7 shows a state in which the bolt-gripping claws 185 grip the bolt-shaft end region 41, that is, an initial state of the fastening operation. In the initial state of the fastening operation, the magnet 177 connected to the ball-screw shaft 169 is located in a position corresponding to the initial-position sensor 178 in the longitudinal-axis direction LD.

When the user manually operates the trigger 115 (see FIG. 2) in the initial state, the electric switch assembly 116 is switched on and the controller 131 normally rotates the motor 135 via the three-phase inverter 134. The manner of "normal rotation" refers to the driving manner in which the ball-screw shaft 169 moves in the rear side direction RR and thereby the bolt-gripping claws 185 move in the rear side direction RR.

Figure 8:
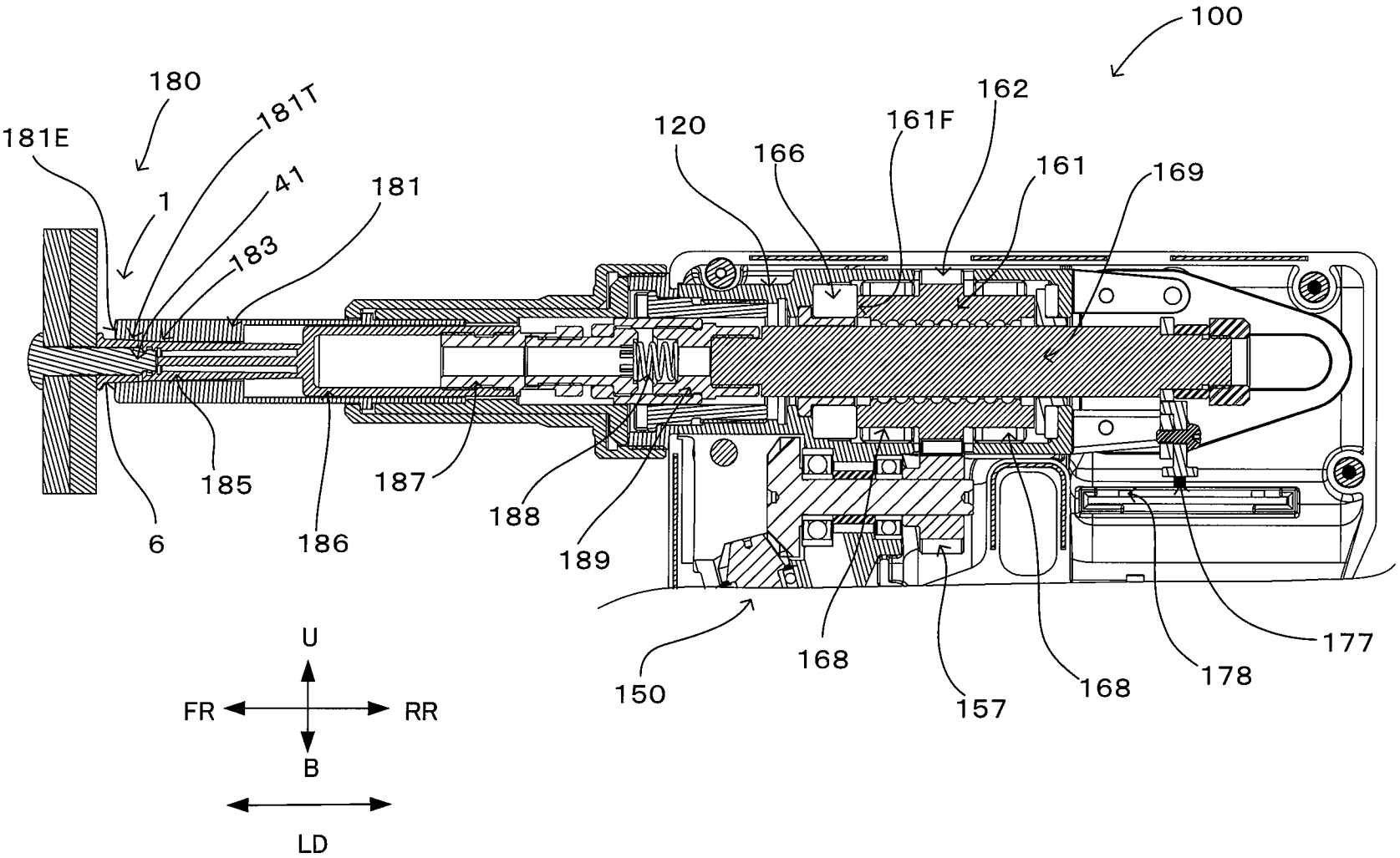
FIG. 8 is a partial sectional view showing an operation state of the fastening tool.

As shown in FIG. 8, when the motor 135 is driven to normally rotate, the driven gear 162 engaged with the ball-nut drive gear 157, which is a final gear in the bevel-gear speed-reducing mechanism 150, is rotationally driven, and thereby the ball nut 161 is rotationally driven in a normal direction (clockwise direction as viewed toward the front side direction FR from the rear side direction RR) around the longitudinal-axis direction LD.

The ball-screw shaft 169 moves in the rear side direction RR while converting rotation of the ball nut 161 into linear motion. At this time, the bolt-gripping claws 185 also move in the rear side direction RR together with the ball-screw shaft 169, and the magnet 177 connected to the ball-screw shaft 169 moves away from the initial-position sensor 178 in the rear side direction RR and out of the detection range of the initial-position sensor 178.

As the bolt-gripping claws 185 move from the initial position in the rear side direction RR, the bolt-shaft end region 41 engaged and gripped by the bolt-gripping claws 185 is pulled in the rear side direction RR. Although the outer diameter of the collar 6 is slightly larger than the diameter of the opening 181E of the anvil bore 183, as the bolt-gripping claws 185 strongly pull the bolt-shaft end region 41 in the rear side direction RR, the collar 6 abuts on the anvil 181 and is restrained from further moving rearward. As the bolt-gripping claws 185 further move in the rear side direction RR, the collar 6 enters the tapered part 181T of the anvil bore 183 from the opening 181 while being reduced in diameter. When entering the tapered part 181T, the collar 6 is pressed in the front side direction FR and inward in the radial direction of the collar 6 and deforms, corresponding to a longitudinal-axis direction component and a radial direction component of the inclination angle $\alpha$ (see FIG. 4) of the tapered part 181T.

Figure 9:
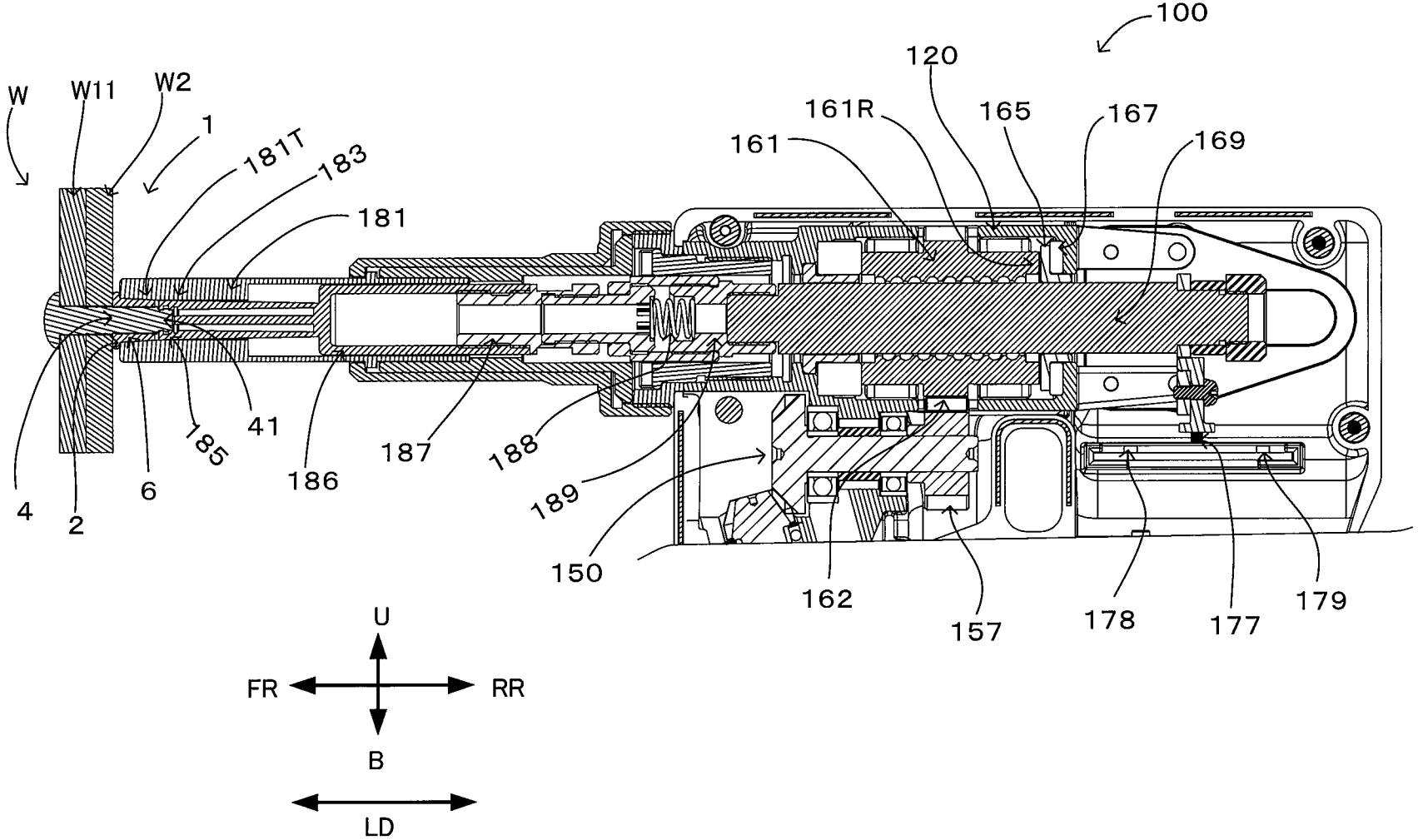
FIG. 9 is a partial sectional view showing an operation state of the fastening tool.

As shown in FIG. 9, as the ball nut 161 is further rotationally driven in the normal direction and the ball-screw shaft 169 moves in the rear side direction RR, the bolt-gripping claws 185 further pull the bolt-shaft end region 41 in the rear side direction RR from the state shown in FIG. 8. Thus, the collar 6 engaged in the anvil 181 proceeds deeper into the tapered part 181T. As a result, the collar 6 is further pressed strongly in the front side direction FR and inward in the radial direction of the collar 6, and the hollow collar part 7 formed as a smooth surface is firmly crimped (swaged) into the grooves 5 (see FIG. 1) formed in the bolt shaft 4. By this crimping, the hollow collar part 7 is engaged with the groove 5 by plastic deformation. Thus, swaging of the fastener 1 is completed and the operation of fastening the workpiece W is completed.

In the process leading to completion of the fastening operation, as shown in FIG. 9, the collar 6 becomes unable to proceed any deeper into the anvil bore 183 (enters a final stage of the fastening operation) before the magnet 177, which has moved away from the initial-position sensor 178, comes close to the rearmost-end-position sensor 179 in the longitudinal-axis direction LD. As a result, the driving current of the motor 135 rapidly increases. The controller 131 shown in FIG. 6 compares a driving current value inputted from the driving-current detection amplifier 133 with the preset threshold. As described above, this threshold may be appropriately selected by the user's manual operation of the operation dial 132 shown in FIG. 2. In the present embodiment, the threshold can be steplessly set according to a required axial force, that is, load required for the fastening operation.

In a case where the driving current value exceeds the specified threshold, the controller 131 determines that the fastening operation by swaging is completed and stops driving of the motor 135 via the three-phase inverter 134. The present embodiment employs a configuration in which an electric brake is actuated to quickly stop the motor 135 in a case where the driving current value exceeds the specified threshold.

In the present embodiment, output management is closely performed based on the driving current, so that the fastening operation can be completed while the fastener 1 shown in FIG. 1 remains integrated with the bolt shaft 4. Thus, the need for an additional operation of caring a broken part of the bolt shaft 4 after the fastening operation can be eliminated, so that the working efficiency can be improved.

As described above, FIG. 9 shows the fastening tool 100 which has completed the fastening operation by swaging. In order to make the fastening tool 100 ready for the next fastening operation, the fastening tool 100 should be returned from the operation-completed state shown in FIG. 9 to the initial state shown in FIG. 7 and the collar 6 swaged to the bolt 2 should be released from the anvil 181.

In the present embodiment, when the fastening operation is completed and the user turns off the trigger 115 (see FIG. 2), the controller 131 shown in FIG. 6 reversely rotates the motor 135 via the three-phase inverter 134. This reverse rotation of the motor 135 is transmitted to the ball nut 161 via the driven gear 162 which is engaged with the ball-nut drive gear 157 of the bevel-gear speed-reducing mechanism 150. Thus, the ball-screw shaft 169 moves in the front side direction FR and the bolt-gripping claws 185 also move in the front side direction FR together with the ball-screw shaft 169. At this time, a considerably strong load is required to release the collar 6 from the anvil 181 since the collar 6 is firmly stuck to the anvil bore 183 due to a strong load applied when the collar 6 was swaged. The load is applied to the ball nut 161 as an axial force in the rear side direction RR via the bolt-gripping claws 185, the bolt-gripping claw base 186, the first connection part 187A, the second connection part 187B, the locking part 188, the third connection part 189 and the ball-screw shaft 169.

In the present embodiment, the rear end part 161R of the ball nut 161 is supported by the inner housing 120 via (the thrust washer 165 and) the thrust needle bearing 167. Therefore, the thrust needle bearing 167 reliably receives the axial force in the rear side direction RR while rolling around the longitudinal-axis direction LD so as to allow the ball nut 161 to rotate, thereby preventing this axial force from impeding smooth rotation of the ball nut 161.

In the present embodiment, the maximum movable range of the ball-screw shaft 169 shown in FIG. 4 in the longitudinal-axis direction LD is set to correspond to the distance between the initial-position sensor 178 and the rearmost-end-position sensor 179. In other words, the distance of movement of the magnet 177 from the position corresponding to the initial-position sensor 178 to the position corresponding to the rearmost-end-position sensor 179 is given as the maximum movable range of the ball-screw shaft 169.

For example, if the trigger 115 is turned on when the bolt-gripping claws 185 are not engaged with the bolt 2, the driving current value of the motor 135 which is substantially under no load does not reach the specified threshold, so that the ball-screw shaft 169 can move in the rear side direction RR until the magnet 177 reaches the rearmost-end-position sensor 179. The state in which the magnet 177 has reached the position corresponding to the rearmost-end-position sensor 179 is defined as a state in which the fastening tool 100 is in a "stop position".

On the other hand, when the bolt-gripping claws 185 grip the bolt 2 of the fastener 1 and the above-described fastening operation by swaging is performed, in the process leading to completion of the fastening operation, the driving current value of the motor 135 rapidly increases. Then, before the magnet 177 reaches the detection range of the rearmost-end-position sensor 179, the driving current value exceeds the specified threshold, and at this point of time, driving of the motor 135 is stopped.

Figure 10:
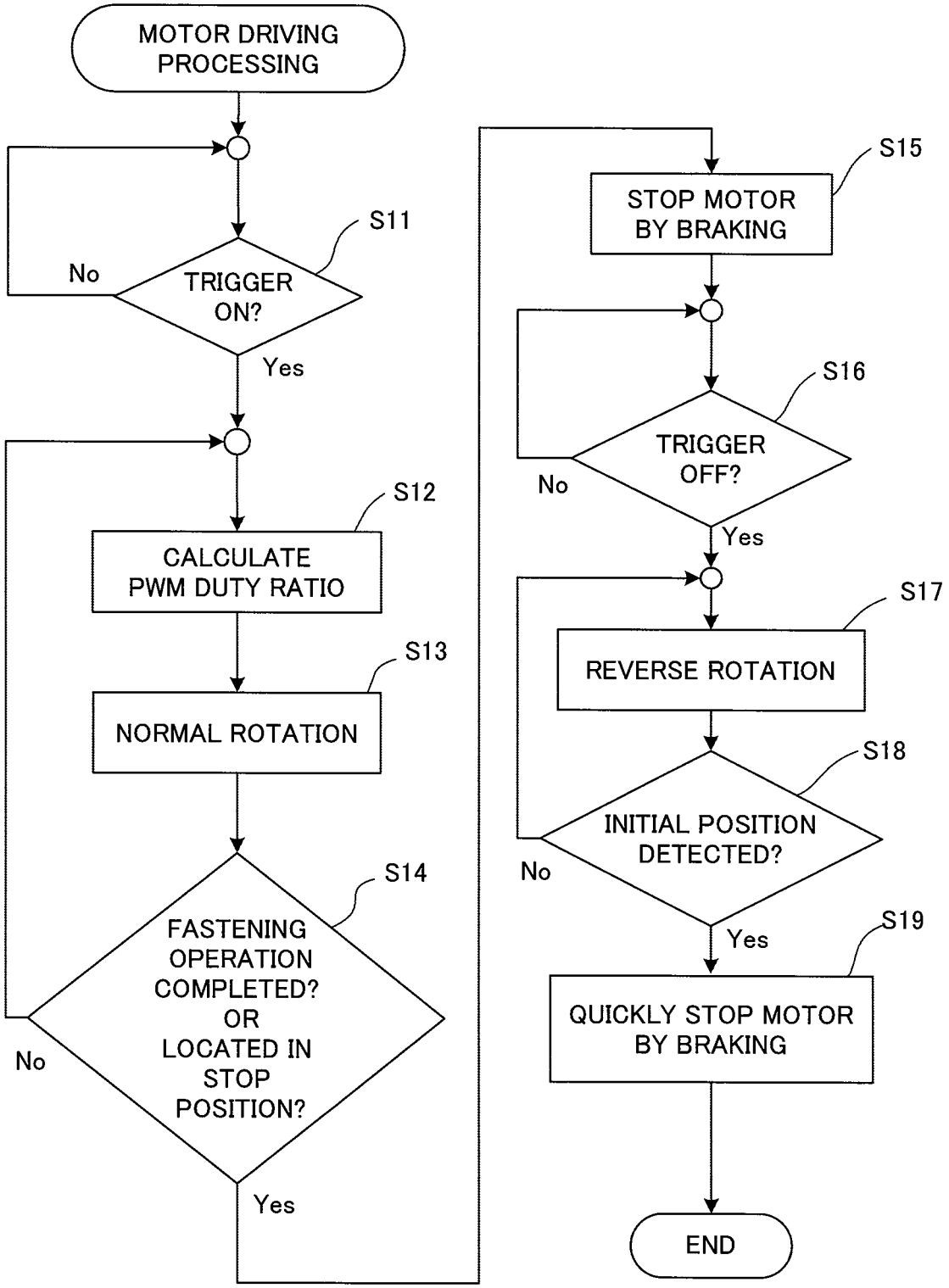
FIG. 10 is a flow chart showing processing steps in the motor-drive-control mechanism.

FIG. 10 shows an overview of a drive control flow in the motor-drive-control mechanism 101. Determination in the drive control flow is made by the controller 131 unless noted otherwise, and reference signs for components which are used in FIGS. 1 to 9 are also used in the following description and not shown in FIG. 10.

In a motor drive control routine, first in step S11, the on/off state of the trigger 115 and the electric switch assembly 116 is monitored. In a case where the on state of the trigger 115 is detected, in step S12, a duty ratio for driving the motor 135 is calculated and a PWM signal is generated in the three-phase inverter 134, and in step S13, the motor 135 is normally rotated. As described above, the "normal rotation" of the motor 135 corresponds to the linear movement of the ball-screw shaft 169 shown in FIG. 4 in the rear side direction RR and the movement of the bolt-gripping claws 185 in the rear side direction RR relative to the anvil 181. By the normal rotation of the motor 135 in step S13, the collar 6 is swaged to the bolt 22 in the fastener 1 shown in FIG. 1.

In step S14, it is determined whether the fastening operation is completed with the above-described driving current of the motor 135 exceeding the specified threshold, or whether the magnet 177 reaches the rearmost-end-position sensor 179 (or is located in the stop position). If completion of the fastening operation or the stop position is detected in step S14, the motor 135 is quickly stopped by an electric brake in step S15.

Subsequently, if a user's operation of turning off the trigger is detected in step S16, the motor 135 is reversely rotated in step S17. This reverse rotation is continued until the magnet 177 reaches the position corresponding to the initial-position sensor 178. If the initial position is detected in step S18, the motor 135 is quickly stopped by the electric brake (step S19) and the motor drive processing is completed.

In the present embodiment, the bolt-gripping claws 185 gripping the bolt-shaft end region 41 are moved in the longitudinal-axis direction LD via the motor 135 relative to the anvil 181 engaged with the collar 6. With this structure, compared with a conventional fastening tool utilizing fluid pressure, the fastening tool can be realized with a simple and compact structure.

Further, in the present embodiment, swaging of the fastener 1 is completed by terminating the movement of the bolt-gripping claws 185 in the rear side direction RR relative to the anvil 181 based on the driving current of the motor 135, via the controller 131.

In order to complete the swaging of the fastener 1 while the bolt-shaft end region 41 remains integrated with the bolt shaft 4, it is necessary to appropriately manage the output (axial force) in the swaging operation to prevent the bolt-shaft end region 41 gripped by the bolt-gripping claws 185 from being broken by an overload. Therefore, in the present embodiment, the output management in the swaging operation is performed based on the driving current of the motor 135. When the axial force increases as the swaging operation progresses, the load of the motor 135, which is the driving source for the swaging operation, increases, which causes an increase in the driving current of the motor 135. Therefore, the output management in the swaging operation is performed by stopping driving of the motor 135 when the driving current of the motor 135 exceeds a specified threshold. If the driving current of the motor 135 increases beyond the specified threshold, an overload caused by excessive torque of the motor 135 may be applied to the fastener 1, which may result in breakage of the bolt-shaft end region 41.

According to the present embodiment, however, the risk of such breakage can reliably be reduced.

Second Embodiment: Addition of Control Based on an Amount of Change in the Rotation Speed of the Motor Next, a second embodiment of the present invention is explained mainly with reference to FIGS. 11 and 12. The second embodiment is a modification relating to the above-described output management which is performed based on the driving current of the motor 135 in the swaging operation in the first embodiment. This modification is provided to avoid the output management from being adversely affected, even if a large starting current is generated at start of the motor, by the large starting current. Therefore, unless noted otherwise, the structures, reference signs and drawings pertaining to the fastening tool 100 which are used in the first embodiment are applied as they are.

Generally, when performing a specified operation by driving a motor, an unexpectedly large starting current may be generated at start of the motor. Such a large starting current is known as a startup inrush current or a rush current. In the first embodiment, in step S14 in FIG. 10, in a case where the driving current value exceeds a specified threshold, it is determined that the fastening operation is completed, and in step S15, the motor 135 is quickly stopped by an electric brake. In the first embodiment, however, if the above-described large starting current is generated in an initial driving stage of the motor 135 and exceeds the threshold, the controller 131 may erroneously determine that the fastening operation is completed at that point of time and stop driving of the motor 135 even if the operation of swaging the fastener 1 is not yet completed.

In order to avoid such occurrence, in the second embodiment, completion of the fastening operation is determined by an amount (rate) of change in the rotation speed of the motor, in addition to comparison of the driving current of the motor 135 with the threshold. Specifically, in the second embodiment, the controller 131 derives the amount of change in the rotation speed of the motor 135 based on the duty ratio and PWM frequency calculated by the three-phase inverter 134 shown in FIG. 6 and information such as the rotor angle of the motor 135 which is detected by the Hall sensors 139. In the second embodiment, a time differential value of the rotation speed of the motor 135 (that is, an angular acceleration) is calculated as the amount of change in the rotation speed. Alternatively, for example, a difference value may be calculated as the amount of change in the rotation speed.

Figure 11:
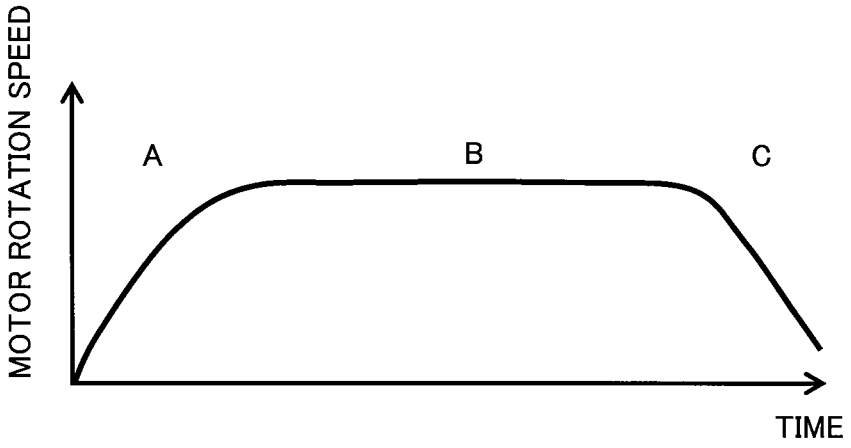
FIG. 11 is a graph showing change in motor rotation speed in a second embodiment of the present invention.

Change with time in the rotation speed of the motor 135 of the fastening tool 100 is shown in FIG. 11. Subsequent to the start of the motor, the rotation speed of the motor 135 increases in the initial driving stage (stage A) and is then kept at a steady speed based on the rated output (stage B).

Figure 12:
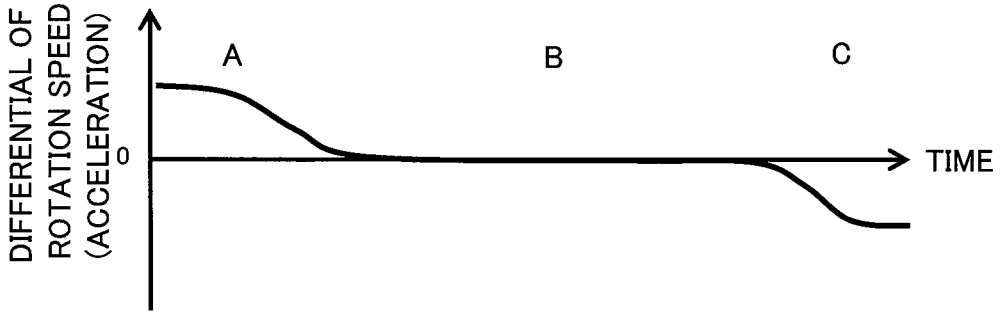
FIG. 12 is a graph showing an amount of change in the motor rotation speed in the second embodiment.

The fastening operation is completed when the collar 6 is firmly crimped to the bolt 2 as shown in FIG. 9. At this time, the bolt-gripping claws 185 can no longer move the bolt 2, so that the rotation speed of the motor 135 which drives the bolt-gripping claws 185 rapidly decreases (stage C in FIG. 11). When the driving current value of the motor 135 rapidly increases with the rapid decrease of the rotation speed of the motor 135 and exceeds the set threshold, it is determined that the fastening operation is completed. As shown in FIG. 12, the amount of change in the rotation speed of the motor 135 takes on a positive value in stage A, zero in stage B and a negative value in stage C.

Having regard to this, in the second embodiment, the controller 131 (see FIG. 6) is configured to determine that the fastening operation is completed only in a case where the amount of change in the rotation speed of the motor 135 takes on a negative value and the driving current value of the motor 135 exceeds a specified threshold.

With this structure, in a case where a large starting current is generated in the initial motor driving stage, the amount of change in the rotation speed of the motor 135 does not take on a negative value (stage A in FIG. 12), so that, even if the large starting current exceeds the specified threshold, the controller 131 dose not determine that the fastening operation is completed. Therefore, the controller 131 can be effectively avoided from erroneously determining that the fastening operation is completed based on the large starting current in the initial motor driving stage. On the other hand, upon completion of the fastening operation, the amount of change in the rotation speed of the motor 135 takes on a negative value in stage C shown in FIG. 12, so that the controller 131 can correctly determine that the fastening operation is completed and stops driving of the motor 135.

Third Embodiment: Control of Rotation Speed According to Threshold

Next, a third embodiment of the present invention is explained mainly with reference to FIGS. 13 to 16. The third embodiment is a modification relating to the above-described output management which is performed based on the driving current of the motor 135 in the first embodiment. In this modification, in order to ensure satisfactory output management, the rotation speed of the motor 135 is appropriately controlled according to a set threshold, so that generation of a large starting current exceeding the threshold can be avoided. Therefore, unless noted otherwise, the structures, reference signs and drawings pertaining to the fastening tool 100 which are used in the first embodiment are applied as they are.

As described above, the fastening tool 100 of the first embodiment has the operation dial 132 for setting a threshold as shown in FIG. 2, and the operation dial 132 has the threshold indication in plural steps. A user can select any threshold according to working specifications such as the material or specifications of the workpiece and the material or specifications of the fastener 1.

Figure 13:
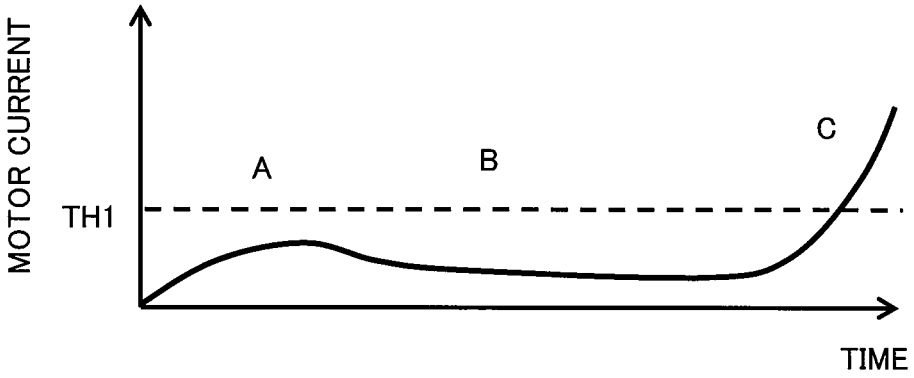
FIG. 13 is a graph showing change in motor driving current in a third embodiment.
Figure 14:
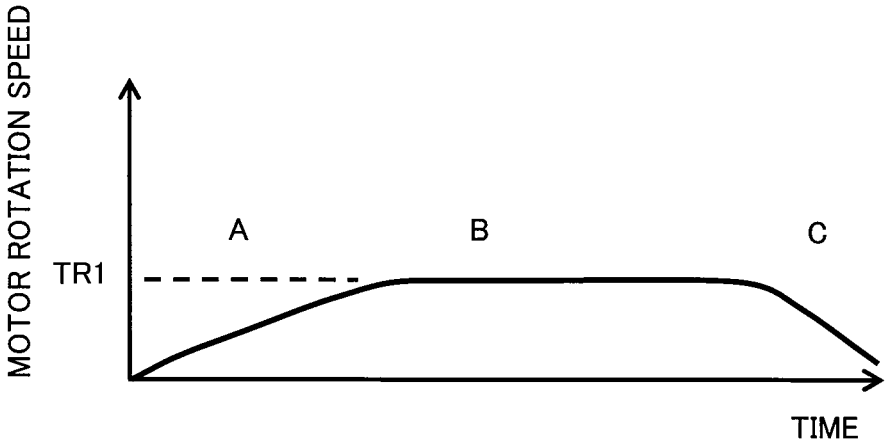
FIG. 14 is a graph showing change in motor rotation speed in the third embodiment.

In a case where a (relatively low) threshold TH1 is selected as shown in FIG. 13, the controller 131 controls a target value of the rotation speed of the motor 135 to be a (relatively low) value TR1 as shown in FIG. 14. In the present embodiment, since driving of the motor 135 is PWM controlled, control of the target value of the rotation speed of the motor 135 is performed by setting the duty ratio.

The target value TR1 is set such that an estimated value of the large starting current in the initial driving stage of the motor 135 does not exceed the threshold TH1. Specifically, the starting current at start of the motor 135 remains below the threshold TH1 (stage A) as shown in FIG. 13, and thereafter in a final stage (stage C) leading to completion of the fastening operation, when the driving current value of the motor 135 exceeds the threshold TH1 with a progress of the swaging operation, it can be correctly determined that the fastening operation is completed.

Figure 15:
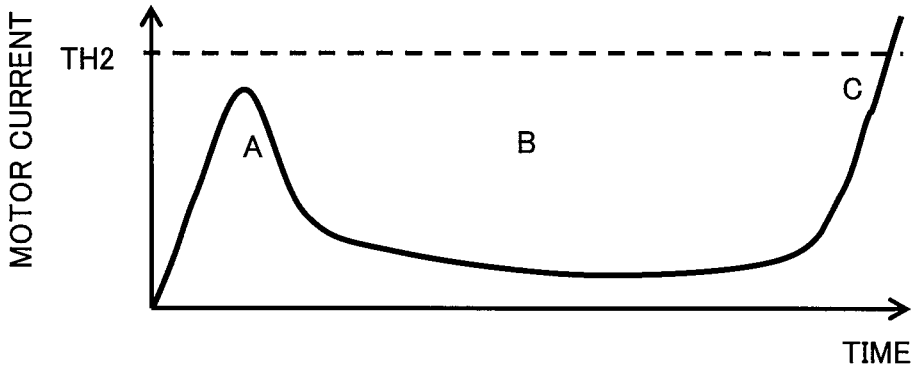
FIG. 15 is a graph showing change in motor driving current in the third embodiment.
Figure 16:
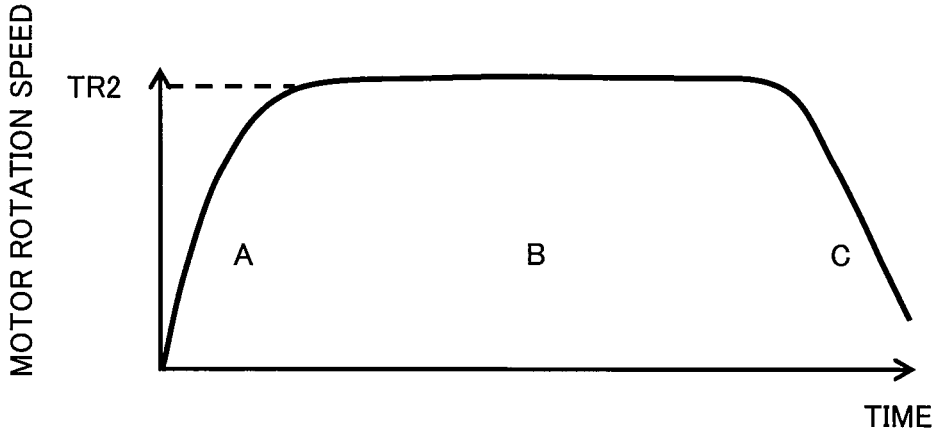
FIG. 16 is a graph showing change in motor rotation speed in the third embodiment.

In a case where a threshold TH2 which is larger than the threshold TH1 shown in FIG. 13 is selected as shown in FIG. 15, the controller 131 sets a target value of the rotation speed of the motor 135 to a value TR2 as shown in FIG. 16. The target value TR2 is relatively larger than the target value TR1 shown in FIG. 14, and the motor 135 is driven at higher speed than in the case shown in FIG. 14. The target value TR2 is set such that the estimated value of the large starting current in the initial driving stage of the motor 135 does not exceed the threshold TH2 (see FIG. 15).

Therefore, the target value of the rotation speed of the motor 135 is set relatively high, but as shown in FIG. 15, the starting current at start of the motor 135 remains below the threshold TH2 (stage A). Thereafter, in a final stage (stage C) leading to completion of the fastening operation, when the driving current of the motor 135 exceeds the threshold TH2 with a progress of the swaging operation, it can be correctly determined that the fastening operation is completed.

With this structure, the controller 131 sets the target rotation speed of the motor 135 such that the starting current of the motor 135 remains below the threshold and thereby controls the starting current of the motor 135 so as not to exceed the threshold. Therefore, the controller 131 can be effectively avoided from erroneously determining at start of the motor that the fastening operation is completed.

Fourth Embodiment: Change of Soft-Start Control Manner According to Threshold Next, a fourth embodiment of the present invention is explained mainly with reference to FIGS. 17 to 20. The fourth embodiment is a modification relating to the above-described output management which is performed based on the driving current of the motor 135 in the first embodiment. In this modification, in order to ensure satisfactory output management, the motor 135 is soft-started and the manner of soft-start control is changed according to the threshold, so that generation of a large starting current exceeding the set threshold can be avoided. Therefore, unless noted otherwise, the structures, reference signs and drawings pertaining to the fastening tool 100 which are used in the first embodiment are applied as they are.

In the fourth embodiment, the controller 131 (see FIG. 6) is configured to appropriately set a target motor rotation speed according to a threshold which is selected by a user with the operation dial 132.

Figure 17:
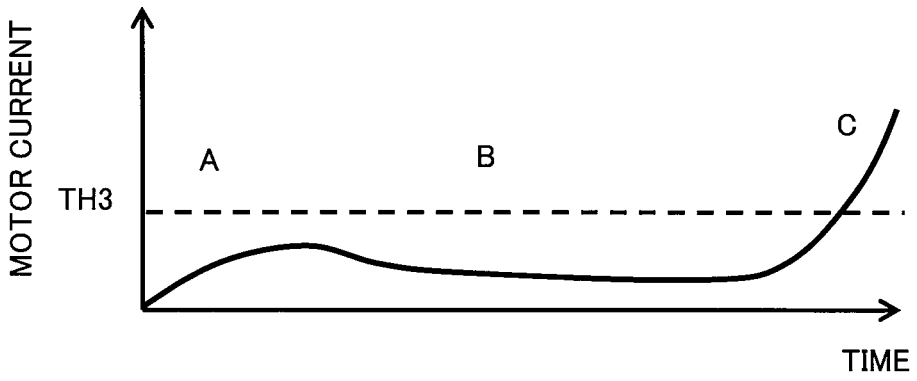
FIG. 17 is a graph showing change in motor driving current in a fourth embodiment.
Figure 18:
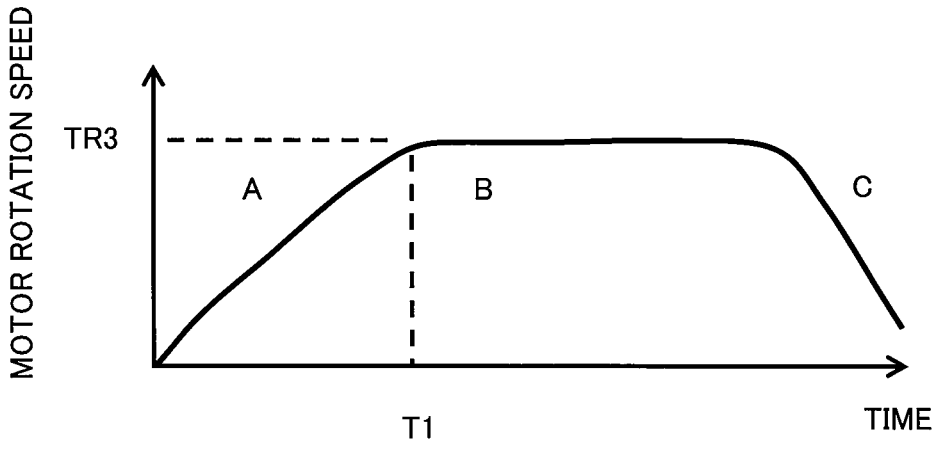
FIG. 18 is a graph showing change in motor rotation speed in the fourth embodiment.

For example, in a case where a threshold TH3 is selected as shown in FIG. 17, the controller 131 controls the motor to be driven by soft-start control until the motor rotation speed reaches a target value TR3 as shown in FIG. 18 (stage A). The Soft-start control of a motor is a well-known technique of controlling start of the motor such that the motor rotation speed gradually increases with time and therefore will not be further elaborated here. In the present embodiment, the soft-start control by voltage mode or by current mode may be suitably adopted.

By controlling the motor 135 to be driven by the soft-start control until the motor rotation speed reaches the target value TR3, as shown in FIG. 17, the starting current of the motor 135 remains below the threshold TH3. Thereafter, in a final stage (stage C) leading to completion of the fastening operation, when the driving current of the motor 135 exceeds the threshold TH3 with a progress of the swaging operation, it can be correctly determined that the fastening operation is completed.

Figure 19:
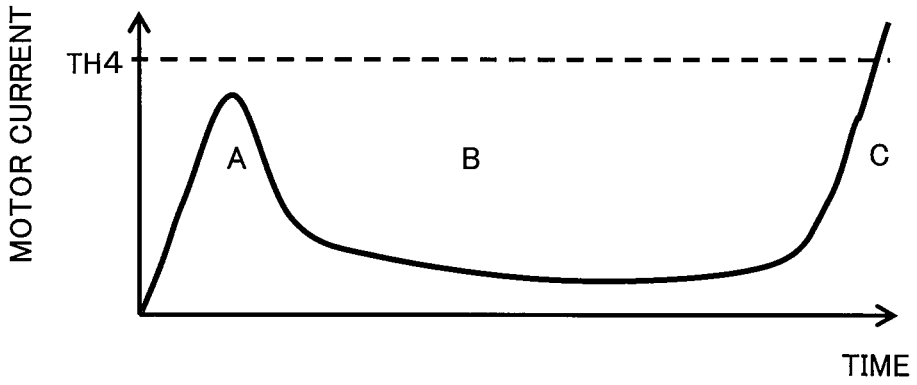
FIG. 19 is a graph showing change in motor driving current in the fourth embodiment.
Figure 20:
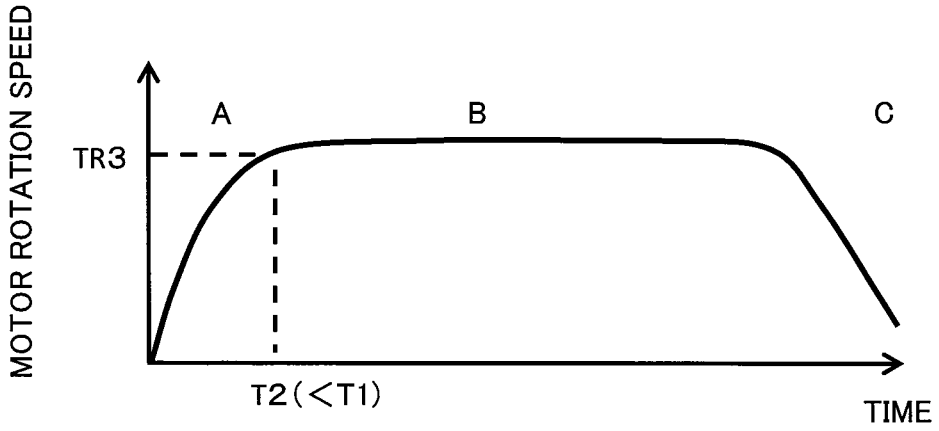
FIG. 20 is a graph showing change in motor rotation speed in the fourth embodiment.

In a case where a relatively large threshold TH4 (which is larger than the threshold TH3) is selected as shown in FIG. 19, the controller 131 sets a target motor rotation speed of the motor to the same value TR3, but changes the manner of the soft-start control as shown in FIG. 20. Specifically, the rising speed of the motor in the soft-start control is changed by applying a control manner in which the angular acceleration during the startup of the motor is higher than that in the control manner shown in FIG. 18. By an increase of the angular acceleration, an arrival time T2 required to reach the target value TR3 in FIG. 20 is made shorter than an arrival time T1 required to reach the target value TR3 in FIG. 18. Further, as shown in FIG. 19, although the angular acceleration during the startup of the motor is increased by selecting the relatively large threshold TH4, the starting current of the motor 135 remains below the threshold TH4 due to the relatively large threshold TH4, and thereafter in a final stage (stage C) leading to completion of the fastening operation, when the driving current of the motor 135 exceeds the threshold TH4 with a progress of the swaging operation, it can be correctly determined that the fastening operation is completed.

In the fourth embodiment, the soft-start control manner is changed such that, when the threshold is changed from TH3 to TH4, the angular acceleration is increased while the target value TR3 of the motor rotation speed is left unchanged. However, the target value of the motor rotation speed may also be changed according to the change of the threshold. For example, although not shown for convenience sake, when the larger threshold TH4 than the threshold TH3 shown in FIG. 17 is selected, the target value of the motor rotation speed may be changed to a larger value TR4 than the value TR3 shown in FIG. 18.

Although, in the present embodiment, the soft-start control manner is changed according to the selected threshold, an alternative configuration may be employed in which, for example, in a case where a relatively large threshold is selected and it is assumed that the starting current in the initial driving stage of the motor 135 does not reach the threshold, the soft-start control is cancelled and switched to a normal drive control manner.

As described above, as shown in FIG. 19, even if the rate of increase of the rotation speed of the motor 135 by the soft-start control is increased, the starting current in the initial driving stage of the motor 135 remains below the threshold TH4 (stage A). Thereafter, in the final stage (stage C) leading to completion of the fastening operation, when the driving current value of the motor 135 exceeds the threshold TH4 with a progress of the swaging operation, it can be correctly determined that the fastening operation is completed.

With this structure, in which the soft-start control is adopted and the drive control manner using the soft-start control is variable, the target rotation speed of the motor 135 is set such that the starting current of the motor 135 remains below the threshold, so that the starting current of the motor 135 is controlled so as not to exceed the threshold. Therefore, the controller 131 can be effectively avoided from erroneously determining at start of the motor that the fastening operation is completed.

Fifth Embodiment: Controlling the Driving Current Value for a Certain Period of Time from Startup Next, a fifth embodiment of the present invention is explained mainly with reference to FIGS. 21 and 22. The fifth embodiment is a modification relating to the above-described output management based on the driving current of the motor 135 in the swaging operation in the first embodiment. In this modification, the starting current is prevented from exceeding the threshold by controlling the driving current of the motor 135 to a certain value or below until a certain period of time elapses from the start of the motor. Therefore, unless noted otherwise, the structures, reference signs and drawings pertaining to the fastening tool 100 which are used in the first embodiment are applied as they are.

Figure 21:
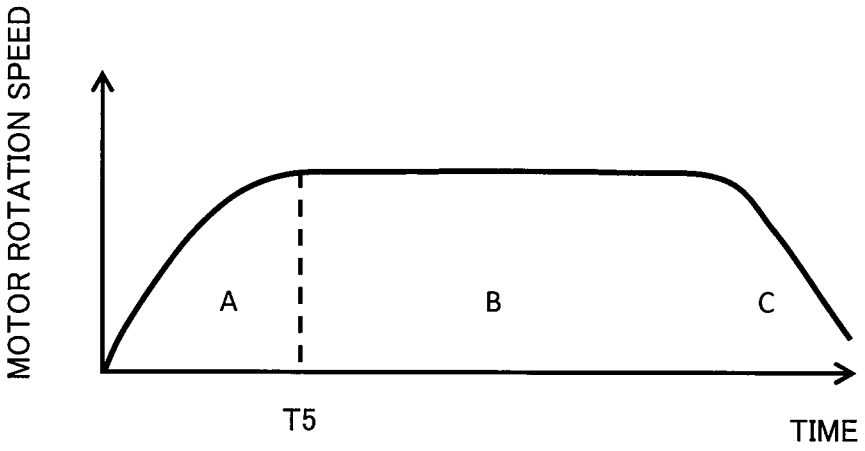
FIG. 21 is a graph showing change in motor rotation speed in a fifth embodiment.
Figure 22:
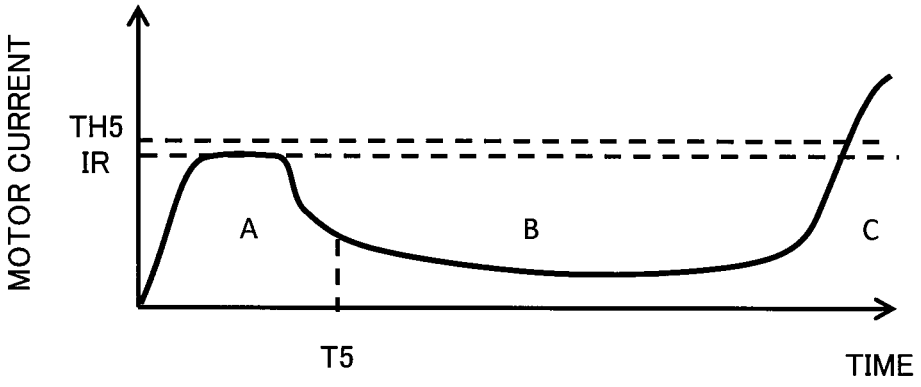
FIG. 22 is a graph showing change in motor driving current in the fifth embodiment.

As shown in FIG. 21, in the initial driving stage of the motor 135, the rotation speed of the motor 135 increases (stage A) and is thereafter kept steady based on a rated output (stage B), and in this state, the above-described operation of swaging the fastener 1 progresses (see FIGS. 7 and 8). In the fifth embodiment, the period of time set for this stage A is defined as set time period T5, and as shown in FIG. 22, the driving current of the motor 135 is controlled to a limit value IR or below until set time period T5 elapses. The limit value IR is set to be smaller than a selected threshold TH5.

After a lapse of set time period T5, driving of the motor 135 is controlled in a normal manner. Thereafter, in a state leading to completion of the swaging operation, the rotation speed of the motor 135 rapidly decreases (stage C in FIG. 21), and the driving current value of the motor 135 rapidly increases (stage C in FIG. 22). When the driving current value of the motor 135 exceeds the threshold TH5, it is determined that the fastening operation is completed.

With this structure, in the motor initial driving stage (stage A), that is, until set time period T5 elapses from the start of the motor 135, generation of a large starting current exceeding the threshold TH5 is prevented by setting the smaller limit value IR than the threshold TH5, so that the starting current of the motor 135 is controlled so as not to exceed the threshold. Therefore, the controller 131 can be effectively avoided from erroneously determining at start of the motor that the fastening operation is completed.

Sixth Embodiment: Restricting Comparison with Threshold for a Certain Period of Time after Startup Next, a sixth embodiment of the present invention is explained mainly with reference to FIGS. 23 and 24. The sixth embodiment is a modification relating to the above-described output management based on the driving current of the motor 135 in the swaging operation in the first embodiment. In this modification, whether the driving current of the motor 135 exceeds the threshold is not determined until a certain period of time elapses from the start of the motor. Thus, the output management is avoided from being adversely affected by a large starting current even if the large starting current is generated at start of the motor.

Therefore, unless noted otherwise, the structures, signs and drawings pertaining to the fastening tool 100 which are used in the first embodiment are applied as they are.

Figure 23:
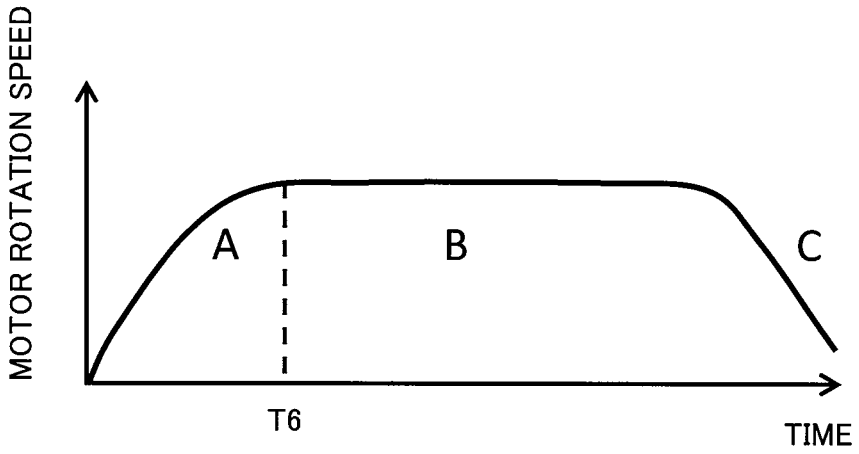
FIG. 23 is a graph showing change in motor rotation speed in a sixth embodiment.

As shown in FIG. 23, in the initial driving stage of the motor 135, the rotation speed of the motor 135 increases (stage A) and is thereafter kept steady (stage B).

Figure 24:
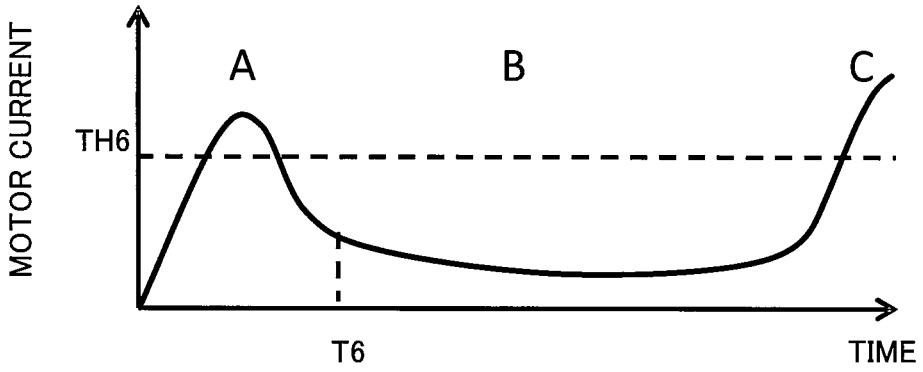
FIG. 24 is a graph showing change in motor driving current in the sixth embodiment.

In the sixth embodiment, the period of time set for this stage A is defined as set time period T6, and the controller 131 is configured not to perform determination shown in step 14 of FIG. 10, that is, determination as to whether the driving current value of the motor 135 exceeds a specified threshold (whether the fastening operation is completed), until set time period T6 elapses. Therefore, as shown in FIG. 24, in the initial driving stage of the motor 135 (stage A for set time period T6 in FIG. 24), even if the starting current of the motor 135 exceeds a selected threshold TH6, the controller 131, which is configured to suspend comparison between the driving current value and the threshold during set time period T6, does not stop driving of the motor 135. Thereafter, in a state leading to completion of the swaging operation, the rotation speed of the motor 135 rapidly decreases (stage C in FIG. 23), and the driving current value of the motor 135 rapidly increases (stage C in FIG. 24) and exceeds the threshold TH6. When the driving current value of the motor 135 exceeds the threshold TH6, it is determined that the fastening operation is completed.

With this structure, in the motor initial driving stage (stage A), that is, until set time period T6 elapses from the start of the motor 135, whether the driving current of the motor 135 exceeds the threshold, that is, whether the fastening operation is completed, is not determined. Therefore, the controller 131 can be effectively avoided from erroneously determining at start of the motor that the fastening operation is completed.

Seventh Embodiment: Drive Control Based on an Amount of Change in the Current Value Next, a seventh embodiment of the present invention is explained with reference to FIGS. 25 and 26.

Figure 25:
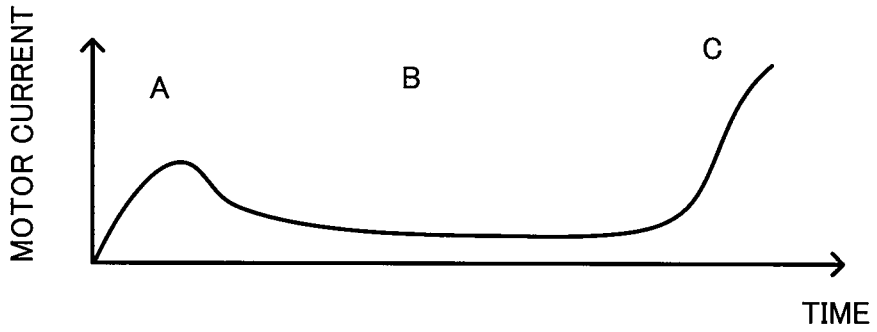
FIG. 25 is a graph showing change in motor driving current in a seventh embodiment.

As shown in FIG. 25, the rise of the large starting current per unit time in the initial driving stage of the motor 135 (stage A) is smaller than the rapid increase of the driving current per unit time in the final stage (stage C) leading to completion of the fastening operation. Thus, the increase of the large starting current is significantly different from the increase of the driving current in the stage of completing the fastening operation.

Focusing on this point, determination of whether the amount of change in the current value exceeds a certain threshold relating to this amount of change can be added to the determination methods of the above-described embodiments. In the seventh embodiment, a current differential value is employed as an example of the amount of change in the current value.

Figure 26:
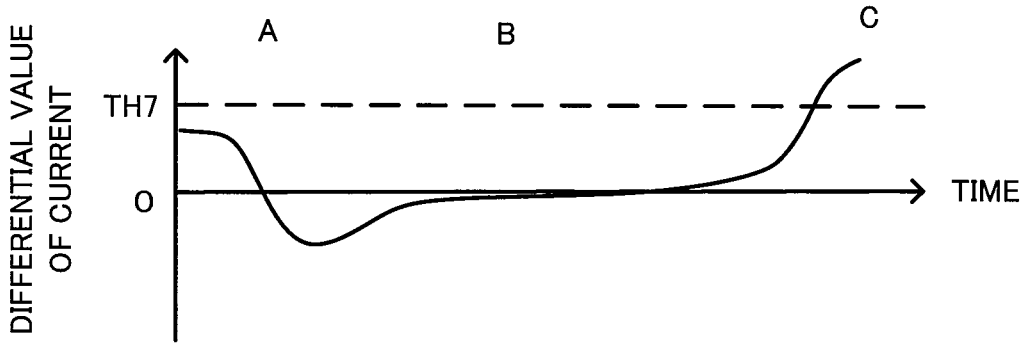
FIG. 26 is a graph showing change in a differential value of motor driving current in the seventh embodiment.

The amount of change in the large starting current in the initial driving stage of the motor 135 (stage A) is not so large, as shown in FIG. 25, and does not exceed a threshold TH7 relating to the current differential value as shown in FIG. 26. Thus, the controller 131 determines that the fastening operation is not yet completed.

On the other hand, in the stage (stage C) leading to completion of the swaging operation in FIG. 25, the driving current of the motor 135 rapidly increases, so that the current differential value in stage C exceeds the threshold TH7, as shown in FIG. 26, and the driving current of the motor 135 exceeds a threshold relating to the driving current. At this point of time, the controller 131 determines that the fastening operation is completed and stops driving of the motor 135.

With this structure, when the large starting current is generated in the initial motor driving stage, the amount of change in the large starting current does not exceed the threshold TH7 relating to this amount of change even if the large starting current exceeds the specified threshold. Accordingly, in this state, the controller 131 does not determine that the fastening operation is completed, so that the controller 131 can be effectively avoided from erroneously determining that the fastening operation is completed based on the large starting current in the initial motor driving stage (stage A).

In light of the above-described structures and operation, according to the present embodiments, the fastening tool 100 can be realized which is capable of completing swaging the fastener 1 while the bolt-shaft end region 41 remains integrated with the bolt shaft 4 without being broken, and has a rational compact structure which is capable of closely managing the axial force. Each of the above-described embodiments is capable of closely managing the axial force alone, or more closely in appropriate combination with one or more of the others.

In view of the nature of the present invention and the present embodiments, the following features may be appropriately employed. Further additional features could be employed by adding any one or more of the following features to each of the claimed inventions.

Aspect 1

"The control part completes the swaging of the fastener further based on an amount of change in the driving current value of the motor."

According to this aspect, the control part can be further effectively avoided from erroneously determining that the fastening operation is completed based on a large starting current in the initial motor driving stage.

Aspect 2

"The bolt-gripping part is moved relative to the anvil in the longitudinal-axis direction via a bolt-gripping part driving mechanism which comprises a ball-screw mechanism."

According to this aspect, by employing the ball-screw mechanism as the bolt-gripping part driving mechanism, rotation of the motor can be rationally converted into linear motion in the longitudinal-axis direction while being sufficiently decelerated.

DESCRIPTION OF THE REFERENCE SIGNS

W: workpiece, W1, W2: member to be fastened, W11, W21: through hole, 1: fastener, 2: bolt, 3: head, 4: bolt shaft, 41: bolt-shaft end region, 5: groove, 6: collar, 7: hollow collar part, 100: fastening tool, 101: motor-drive-control mechanism, 110: outer housing, 111: motor housing region, 112: speed-reducing-gear housing region, 113: inner-housing housing region, 114: grip part, 115: trigger, 116: electric switch assembly, 117: controller housing region, 118: battery mounting part, 120: inner housing, 120H: hole, 121: ball-screw mechanism housing region, 122: guide-flange mounting arm, 123: guide flange, 124: guide hole, 125: sleeve, 126: sleeve bore, 127: joint sleeve, 130: battery, 131: controller, 132: operation dial, 133: driving-current detection amplifier, 134: three-phase inverter, 135: motor, 136: motor output shaft, 137: bearing, 138: cooling fan, 139: Hall sensor, 140: planetary-gear speed-reducing mechanism, 141A: first sun gear, 142A: first planetary gear, 143A: first internal gear, 141B: second sun gear, 142B: second planetary gear, 143B: second internal gear, 144: carrier, 150: bevel-gear speed-reducing mechanism, 151: drive-side intermediate shaft, 152: bearing, 153: drive-side bevel gear, 154: driven-side intermediate shaft, 155: bearing, 156: driven-side bevel gear, 157: ball-nut drive gear, 160: ball-screw mechanism, 161: ball nut, 161F: front end part, 161R: rear end part, 162: driven gear, 163: bore, 164: groove, 165: thrust washer, 166: thrust ball bearing, 167: thrust needle bearing, 168: radial needle bearing, 169: ball-screw shaft, 169L: rotation axis, 171: threaded engagement part, 172: roller shaft, 173: roller, 174: end cap, 175: arm mounting screw, 176: arm, 177: magnet, 178: initial-position sensor, 179: rearmost-end-position sensor, 180: bolt-gripping mechanism, 181: anvil, 181T: tapered part, 182: sleeve lock rib, 183: anvil bore, 185: bolt-gripping claw, 186: bolt-gripping claw base, 187A: first connection part, 187B: second connection part, 187C: locking flange, 188: locking part, 188A: locking end part, 189: third connection part, 190: space

The invention claimed is:

1. A fastening tool, which uses a fastener including a bolt and a cylindrical hollow collar that is engageable with the bolt, the bolt having a head part integrally formed with a shaft part having a groove, to fasten a workpiece between the head part and the collar, the fastening tool comprising:

a bolt-gripping part configured to grip an end region of the shaft part, an anvil configured to be engaged with the collar, a motor configured to drive and move the bolt-gripping part relative to the anvil in a specified longitudinal-axis direction, and a control part configured to control driving of the motor, wherein:

the fastening tool is configured such that, when the bolt-gripping part grips the end region of the shaft part and moves relative to the anvil in a specified first direction of the longitudinal-axis direction, the anvil presses the collar fitted onto the shaft part in a second direction opposite to the first direction of the longitudinal-axis direction and inward in a radial direction of the collar, so that a hollow part of the collar is crimped to the groove while the workpiece is clamped between the collar and the head part, whereby swaging of the fastener is completed while the end region remains integrated with the shaft part, the control part is configured to complete swaging of the fastener by terminating a movement of the bolt-gripping part in the first direction relative to the anvil based on driving current of the motor, and the control part is configured to complete the swaging of the fastener further based on an amount of change in rotation speed of the motor.

2. The fastening tool as defined in claim 1, wherein:

the control part completes is configured to complete the swaging of the fastener through comparison between the driving current of the motor and a specified threshold, and the threshold is adjustable.

3. The fastening tool as defined in claim 2, wherein the control part is configured to control a starting current of the motor so as not to exceed the threshold.

4. The fastening tool as defined in claim 2, wherein, when the threshold is adjusted, the control part is configured to control a starting current of the motor according to the adjusted threshold.

5. The fastening tool as defined in claim 3, wherein the control part is configured to control a target rotation speed of the motor.

6. The fastening tool as defined in claim 2, wherein the control part is configured to control the motor to soft-start and a manner of the soft-start control is variable according to the threshold.

7. The fastening tool as defined in claim 2, wherein the control part is configured to limit the driving current of the motor to a specified set current value or below for a specified period of time after start of the motor.

8. The fastening tool as defined in claim 7, the set current value is variable according to the threshold.

9. The fastening tool as defined in claim 1, wherein the control part is configured to terminate the movement of the bolt-gripping part relative to the anvil in the first direction based on the driving current of the motor only when a specified period of time elapses from start of the motor.

* * * * *